US006701738B2

(12) United States Patent
Kobayashi et al.

(10) Patent No.: US 6,701,738 B2
(45) Date of Patent: Mar. 9, 2004

(54) WIRE FIXING STRUCTURE, ELECTRICAL EQUIPMENT MOUNT DEVICE AND AIR CONDITIONER USING THE SAME

(75) Inventors: Kiyoshi Kobayashi, Tochigi (JP); Masakazu Hosoya, Gunma (JP); Akira Okada, Tochigi (JP); Junichi Goya, Gunma (JP)

(73) Assignee: Sanyo Electric Co., Ltd., Osaka (JP)

( * ) Notice: Subject to any disclaimer, the term of this patent is extended or adjusted under 35 U.S.C. 154(b) by 0 days.

(21) Appl. No.: 10/232,102

(22) Filed: Aug. 28, 2002

(65) Prior Publication Data

US 2003/0042010 A1 Mar. 6, 2003

(30) Foreign Application Priority Data

Sep. 5, 2001 (JP) ..... P2001-268586
Sep. 7, 2001 (JP) ..... P2001-271200
Sep. 20, 2001 (JP) ..... P2001-286193

(51) Int. Cl.[7] ..... F25D 23/12
(52) U.S. Cl. ..... 62/262; 454/201
(58) Field of Search ..... 62/262, 263, 298, 62/259.1; 165/122, 47, 48; 454/201

(56) References Cited

U.S. PATENT DOCUMENTS 6,053,004 A * 4/2000 Beppu et al. ..... 62/285

FOREIGN PATENT DOCUMENTS

JP Hei 4-5935 4/1992
JP Hei 4-40110 4/1992

* cited by examiner

*Primary Examiner*—Chen Wen Jiang
(74) *Attorney, Agent, or Firm*—Darby & Darby

(57) ABSTRACT

In an air conditioner having an electrical equipment mount device containing at least one circuit board on which electrical parts connected to wires are mounted, plural wire abutting portions are formed on a wire fixing face so as to be different in height from said wire fixing face, and a wire is fixedly pinched between a wire press member and one of the wire abutting portions that is selected in accordance with the diameter of the wire. The wire fixing face has a conduit fixing member having a conduit fixing face to which one end portion of a conduit having electrical wires inserted therein is fixed. Plural engaging holes are formed in the wire fixing face, and the conduit fixing member is equipped with plural engaging members which are fixedly engageable with the engaging holes of the electrical equipment mount plate. The engaging members are located at different positions on the conduit fixing member with respect to the conduit fixing face.

4 Claims, 14 Drawing Sheets

WIRE FIXING STRUCTURE, ELECTRICAL EQUIPMENT MOUNT DEVICE AND AIR CONDITIONER USING THE SAME

BACKGROUND OF THE INVENTION

1. Field of the Invention

The present invention relates to a wire fixing structure, an electrical equipment mount device having the wire fixing structure, and an air conditioner having the electrical equipment mount device and including an indoor heat exchanger, an indoor fan, an outdoor heat exchanger and an outdoor fan which are integrally equipped.

2. Description of the Related Art

There has been known an integral-type air conditioner in which an indoor heat exchanger, an indoor fan, an outdoor heat exchanger and an outdoor fan are integrally assembled and also the inside of the air conditioner is partitioned into an indoor-side chamber having the indoor heat exchanger and the indoor fan arranged therein and an outdoor-side chamber having the outdoor heat exchanger and the outdoor fan arranged therein by a partition plate. The air conditioner is further equipped with an operating portion having various kinds of electrical parts such as circuit boards, control buttons, etc. for controlling the compressor, the indoor fan, the outdoor fan, etc.

The air conditioner thus constructor has a cabinet which is disposed so as to penetrate through the wall of a building while the outer heat exchanger, the outdoor fan, etc. are accommodated therein, and a front panel which is fixed to the front end portion of the cabinet and disposed so as to project toward the room. The front panel is equipped with a laterally-elongated opening portion at the upper portion thereof and an air blow-out grille which is disposed in juxtaposition with the operating portion in the horizontal direction.

In the air conditioner thus constructed, the operating portion has an electrical equipment mount device disposed inside the cabinet and/or the front panel. A circuit board such as a control board for controlling the compressor, the indoor fan, the outdoor fan, etc. or the like on which electrical parts are mounted is disposed on the electrical equipment mount device. The electrical equipment mount device is disposed substantially beneath an operation door covering the opening portion as disclosed by Post-examined Utility Model Application No. Hei-4-40110).

In the operating portion thus constructed, various wires such as electrical wires for power supply, etc. are connected to a power supply circuit equipped to the control board, and these electrical wires are fixed to the wire fixing face of the electrical equipment mount device by fixing the electrical wires onto the wire fixing face with a pressing member or the like. Particularly in the case where a high voltage (for example, 265V) is supplied to the control circuit through the electrical wires for power supply, the electrical wires for power supply are disposed while inserted in a conduit in order to protect the electric wires from the external force.

When such an integral type air conditioner is set up in a room of a building, the air conditioner is usually set up in the room so that the cabinet disposed so as to penetrate through the wall of the building is located at the height corresponding to the waist of a user. In this case, the user may put a glass containing liquid such as drinking water or the like on the front panel or the cabinet. If the glass is turned over, the liquid drops through the operation opening into the electrical equipment mount device, thereby inducing insulation failure of the electrical parts.

Further, when the electric wires are fixed to the wire fixing face of the electrical equipment mount device as described above, the electric wires are fixed between the wire fixing face of the electrical equipment mount device and the press member. When the electric wires are used for power supply, the diameter of each electric wire is varied in accordance with the magnitude of the power to be supplied. Therefore, the press member for fixing the electric wires against the wire fixing face must be varied in shape in accordance with the wire diameter of the electric wires being used, and thus plural kinds of press members must be prepared to fix the electric wires being used to the wire fixing face. Therefore, the number of press members (parts) is increased, so that the cost of the air conditioner rises up.

In addition, in the case where a conduit is equipped to protect the electrical wires from the external force as described above, as disclosed in Japanese Post-examined Utility Model Application No. Hei-4-5935, a conduit fixing member for fixing conduits to the lower panel of a heat exchanger is constructed as a projecting piece which is integrally formed on a large-size plate (lower panel). In this case, a screwed fixing member is equipped to the tip of each conduit. The tip portions of the conduit penetrate through fixing holes formed in the conduit fixing member (the projecting piece), and then the screwed fixing members of the conduits are threadedly engaged with nuts to thereby fix the conduits to the conduit fixing member, so that the electrical wires can be excellently protected from the force acting on the conduits. In this case, the conduit fixing member for fixing the conduits to the lower panel must be designed as a large-size part (projecting piece) integrally formed with the lower panel. Further, the lower panel is fixed to the front panel and the back panel by using many screws. Accordingly, it is cumbersome to fix the lower panel having the projecting piece to the front and back panels, and the manufacturing cost rises up because it needs many screws.

SUMMARY OF THE INVENTION

Therefore, the present invention has been implemented in view of the foregoing situation, and has an object to provide a wire fixing structure, an electrical equipment mount device and an air conditioner which can reduce the number of parts to thereby reduce the manufacturing cost.

Another object of the present invention is to provide an electrical equipment mount device and an air conditioner which can miniaturize a conduit fixing member for fixing the end portions of conduits for electrical wiring.

Further object of the present invention is to provide an air conditioner which can protect an electrical equipment mount device from invasion of foreign matters such as liquid materials, for example, drinking water, etc.

In order to attain the above objects, according to a first aspect of the present invention, a wire fixing structure for fixing at least one wire to a wire fixing face, comprises: plural wire abutting portions that are formed on the wire fixing face so as to be different in height from the wire fixing face; and a wire press member for fixing the wire to the wire fixing face by pinching the wire between the wire press member and the wire fixing face, wherein the wire is pinched between the wire press member and one of the wire abutting portions that is selected in accordance with the diameter of the wire, thereby fixing the wire to the wire fixing face.

In the above wire fixing structure, each of the wire abutting portions comprises any one of a recess portion, a flat portion and a projecting portion with respect to the wire fixing face.

In the above wire fixing structure, the press member comprises a U-shaped press body, flanges that are formed integrally with the U-shaped press body at both the ends of the U-shaped press body, and a press portion which expands outwardly from the inner surface of the U-shaped press body and abuts against the wire.

In the above wire fixing structure, an engaging hole is formed in the wire fixing face at one side of each of the abutting portions so that one of the flanges is engagedly fitted in the engaging hole, and a fitting hole is formed in the wire fixing face at the other side of each of the abutting portion so that the other flange is fixedly fitted in the fitting hole by a screw.

According to a second aspect of the present invention, an electrical equipment mount device containing at least one circuit board on which electrical parts connected to wires are mounted is characterized by comprising: a wire fixing plate on which the wires connected to the electrical parts are fixed; plural wire abutting portions that are formed on the wire fixing face so as to be different in height from the wire fixing face; and a wire press member for fixing the wire to the wire fixing face by pinching the wire between the wire press member and the wire fixing face, wherein the wire is pinched between the wire press member and one of the wire abutting portions that is selected in accordance with the diameter of the wire, thereby fixing the wire to the wire fixing face.

In the above electrical equipment mount device, each of the wire abutting portions comprises any one of a recess portion, a flat portion and a projecting portion with respect to the wire fixing face.

According to a third aspect of the present invention, an electrical equipment mount device containing at least one circuit board on which electrical parts connected to wires are mounted is characterized by comprising: an electrical equipment mount plate having a back surface on which the at least one circuit board is mounted, and a front surface on which the wires connected to the electrical parts are fixed; and a conduit fixing member having a conduit fixing face to which one end portion of a conduit having electrical wires inserted therein is fixed, wherein the electrical equipment mount plate is equipped with plural engaging holes, and the conduit fixing member is equipped with plural engaging members which are fixedly engageable with the engaging holes of the electrical equipment mount plate, the engaging members being located at different positions on the conduit fixing member with respect to the conduit fixing face.

In the above electrical equipment mount device, the engaging members are located at opposite sides with respect to the conduit fixing face in the vertical direction to the conduit fixing face.

In the above electrical equipment mount device, the conduit fixing member is equipped with flange portions at both the confronting sides of the conduit fixing face so that the flange portions are bent in the opposite directions, and the flange portions are equipped with the engaging members at one end portions thereof.

The above electrical equipment mount device further comprises a terminal table on which one ends of the electrical wires and one ends of the wires connected to the electrical parts are fixed and connected to one another, the terminal table being fixed to the front surface of the electrical equipment mount plate.

The above electrical equipment mount device further comprises a cover fixed to the front surface of the electrical equipment mount plate so as to cover the terminal table and the conduit fixing member.

According to a fourth aspect of the present invention, an air conditioner comprising an indoor heat exchanger, an indoor fan, an outdoor heat exchanger and an outdoor fan which are integrally equipped, and an electrical equipment mount device containing at least one circuit board on which electrical parts connected to wires is mounted is disposed at the indoor-side chamber side, the indoor heat exchanger and the indoor fan being disposed in an indoor-side chamber while the outdoor heat exchanger and the outdoor fan are disposed in an outdoor-side chamber, and the indoor-side chamber and the outdoor-side chamber being partitioned by a partition plate, is characterized in that the electrical equipment mount device comprising: a wire fixing plate on which the wires connected to the electrical parts are fixed; plural wire abutting portions that are formed on the wire fixing face so as to be different in height from the wire fixing face; and a wire press member for fixing the wire to the wire fixing face by pinching the wire between the wire press member and the wire fixing face, wherein the wire is pinched between the wire press member and one of the wire abutting portions that is selected in accordance with the diameter of the wire, thereby fixing the wire to the wire fixing face.

In the above air conditioner, each of the wire abutting portions comprises any one of a recess portion, a flat portion and a projecting portion with respect to the wire fixing face.

In the above air conditioner, the press member comprises a U-shaped press body, flanges that are formed integrally with the U-shaped press body at both the ends of the U-shaped press body, and a press portion which expands outwardly from the inner surface of the U-shaped press body and abuts against the wire.

In the above air conditioner, an engaging hole is formed in the wire fixing face at one side of each of the abutting portions so that one of the flanges is engagedly fitted in the engaging hole, and a fitting hole is formed in the wire fixing face at the other side of each of the abutting portion so that the other flange is fixedly fitted in the fitting hole by a screw.

According to a fifth aspect of the present invention, an air conditioner comprising an indoor heat exchanger, an indoor fan, an outdoor heat exchanger and an outdoor fan which are integrally equipped, and an electrical equipment mount device containing at least one circuit board on which electrical parts connected to wires are mounted, the indoor heat exchanger and the indoor fan being disposed in an indoor-side chamber while the outdoor heat exchanger and the outdoor fan are disposed in an outdoor-side chamber, and the indoor-side chamber and the outdoor-side chamber being partitioned by a partition plate, is characterized in that the electrical equipment mount device comprising: an electrical equipment mount plate having a back surface on which the at least one circuit board is mounted, and a front surface on which the wires connected to the electrical parts are fixed; and a conduit fixing member having a conduit fixing face to which one end portion of a conduit having electrical wires inserted therein is fixed, wherein the electrical equipment mount plate is equipped with plural engaging holes, and the conduit fixing member is equipped with plural engaging members which are fixedly engageable with the engaging holes of the electrical equipment mount plate, the engaging members being located at different positions on the conduit fixing member with respect to the conduit fixing face.

In the above air conditioner, the engaging members are located at opposite sides with respect to the conduit fixing face in the vertical direction to the conduit fixing face.

In the above air conditioner, the conduit fixing member is equipped with flange portions at both the confronting sides of the conduit fixing face so that the flange portions are bent in the opposite directions, and the flange portions are equipped with the engaging members at one end portions thereof.

The above air conditioner further comprises a terminal table on which one ends of the electrical wires and one ends of the wires connected to the electrical parts are fixed and connected to one another, the terminal table being fixed to the front surface of the electrical equipment mount plate.

The above air conditioner further comprises a cover fixed to the front surface of the electrical equipment mount plate so as to cover the terminal table and the conduit fixing member.

According to a sixth aspect of the present invention, an air conditioner comprising an indoor heat exchanger, an indoor fan, an outdoor heat exchanger and an outdoor fan which are integrally equipped, a cabinet disposed so as to penetrate through a wall of a building while the outdoor heat exchanger and the outdoor fan are accommodated in the cabinet, and a front panel that is located at an indoor side and fixed to the indoor-side end portion of the cabinet, the cabinet having a laterally-elongated opening portion formed at the upper portion thereof, both of an air blow-out grille and an operation control unit being disposed in juxtaposition with each other in the opening portion, and an indoor-side chamber containing the indoor heat exchanger and the indoor fan and an outdoor-side chamber containing the outdoor heat exchanger and the outdoor fan are partitioned by a partition plate fixed to the bottom plate of the cabinet at the bottom portion thereof, is characterized in that the operation control unit comprises an operation box in which a first circuit board is disposed and an electrical equipment mount box in which a second circuit board is disposed, and the electrical equipment mount box is disposed in an area extending from the outdoor-side edge of the opening portion to the outdoor-side chamber.

In the above air conditioner, the electrical equipment mount box is disposed substantially beneath the joint portion between the cabinet and the front panel, and the partition plate has a first top panel extending from the upper edge of the back plate of the partition plate toward the front panel and a second top panel that is joined to the first top panel and extends toward the front side of the front panel, the first top panel being disposed to be interposed between the joint portion and the electrical equipment mount box and designed to be downwardly sloped to the outdoor-side chamber, so that liquid invading through the joint portion flows along the sloped first top plate toward the outdoor-side chamber with no invasion of the liquid into the electrical equipment mount box.

In the above air conditioner, the electrical equipment mount box is disposed substantially beneath the joint portion between the cabinet and the front panel, and the electrical equipment mount box has a front plate on which the second circuit board is disposed and a top plate extending from the upper edge of the front plate toward the outdoor-side chamber so that one edge of the top plate is located at a position nearer to the outdoor-side chamber than the joint portion between the first and second top plates of the partition plate and designed to be downwardly sloped toward the front side of the front panel, so that liquid invading through the joint portion flows along the sloped top plate toward the front side of the front plate with no invasion of the liquid into the electrical equipment mount box.

In the above air conditioner, the partition plate has a first top panel extending from the upper edge of the back plate of the partition plate toward the front panel, and a second top panel that extends toward the front side of the front panel and is bent at the front edge thereof and joined to the first top panel at the back edge thereof, the operation box has a sloped top plate on which operation switches are mounted, and the top plate is equipped with a collar portion at the back side thereof that is fixed to the bent front edge of the second top panel so that liquid invading through the opening portion flows along the surface of the sloped top plate of the operation box with no invasion of the liquid through the joint portion between the top plate of the operation box and the second top panel of the partition plate.

DETAILED DESCRIPTION OF THE PREFERRED EMBODIMENTS

Preferred embodiments according to the present invention will be described hereunder with reference to the accompanying drawings.

Figure 1:
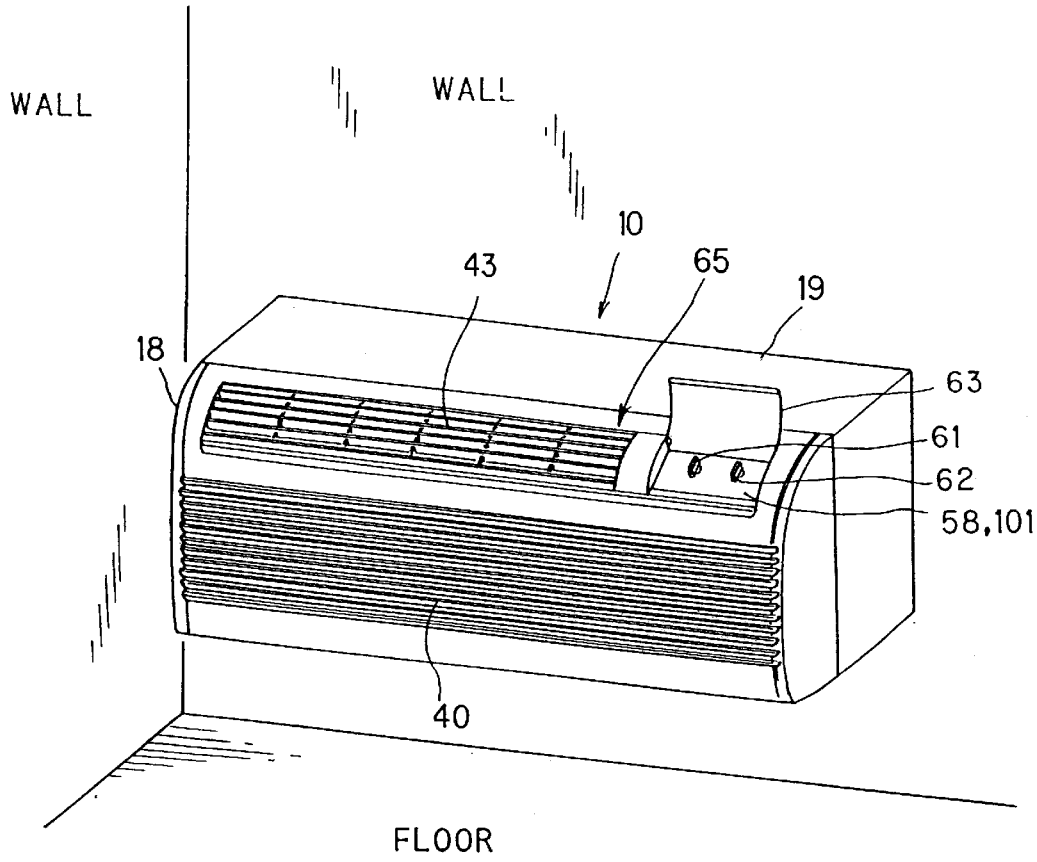
FIG. 1 is a perspective view showing the outlook of an embodiment of an air conditioner according to the present invention.
Figure 2:
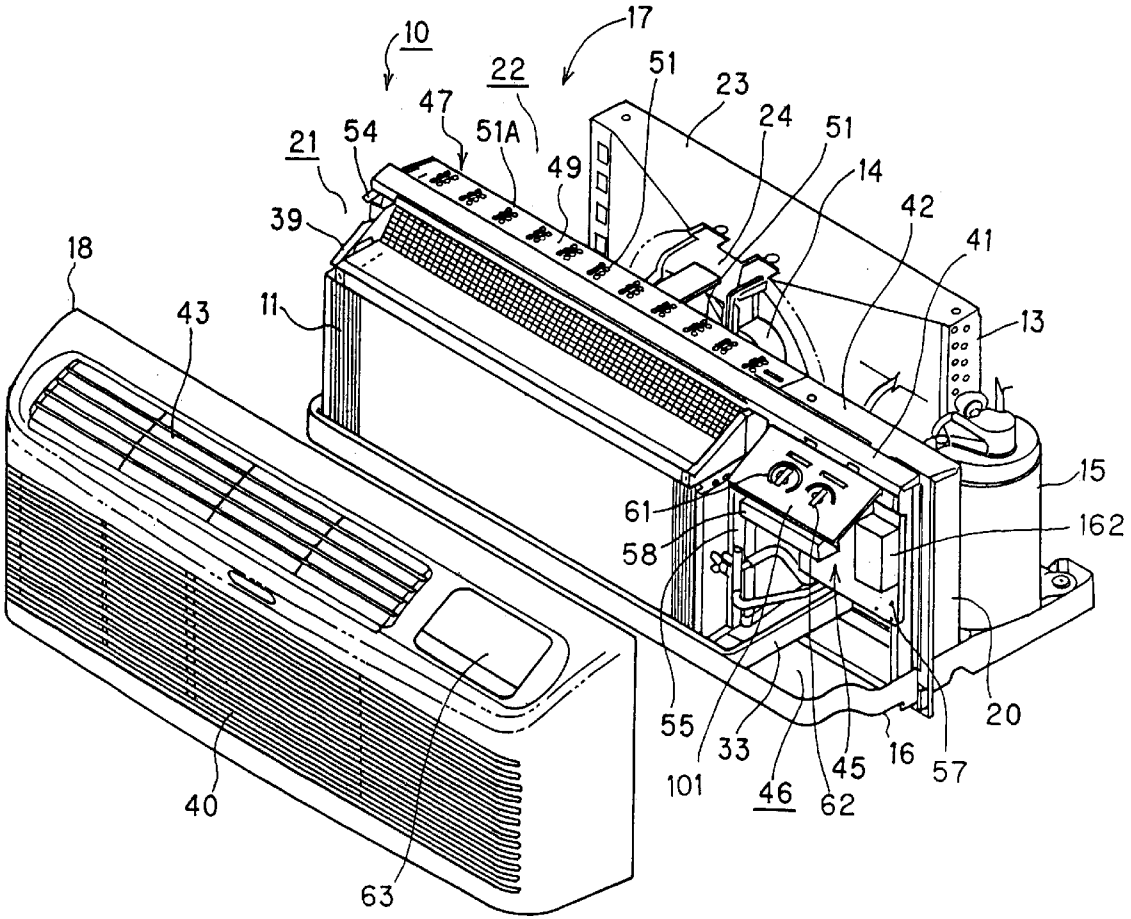
FIG. 2 is an exploded perspective view showing the air conditioner shown in FIG. 1 when a cabinet is omitted.

FIG. 1 is a perspective view showing the outlook of an air conditioner according to the present invention particularly when the air conditioner is set up at the height corresponding the waist position of users on the wall of a building so as to penetrate through the wall, and FIG. 2 is an exploded perspective view showing the air conditioner of FIG. 1 when a cabinet is omitted from the illustration. When the air conditioner is set up, a part of the cabinet is projected to the room side (for example, it is projected to the room side by about 70 mm, for example), and the other part thereof outwardly penetrates through the wall of the building.

The air conditioner 10 shown in FIGS. 1 and 2 is an integral-type air conditioner which is set up while penetrating through the wall of the building, and it comprises an indoor heat exchanger 11, a cross-flow fan 12 (FIG. 3) serving as an indoor fan, an outdoor heat exchanger 13, a propeller fan 14 serving as an outdoor fan, a compressor 15, etc. which are integrally fabricated.

The indoor heat exchanger 11, the cross-flow fan 12, the outdoor heat exchanger 13, the propeller fan 14, the compressor 15, etc. are disposed on the bottom plate 16 to constitute the main body 17 of the air conditioner. The front side of the air-conditioner main body 17 (that is, the arrangement side of the indoor heat exchanger 11 and the cross-flow fan 12) is covered by a front panel 18, and the rear side thereof (that is, the arrangement side of the outdoor heat exchanger 13, the propeller fan 14 and the compressor 15) is covered by a cabinet 19. The front panel 18 is located to face the inside of the room of the building. The cabinet 19 is set up in the wall of the building while it penetrates through the wall of the building, and the cabinet 19 is designed to have a sleeve-like shape such as a cylindrical shape, a prismatic shape or the like.

Figure 3:
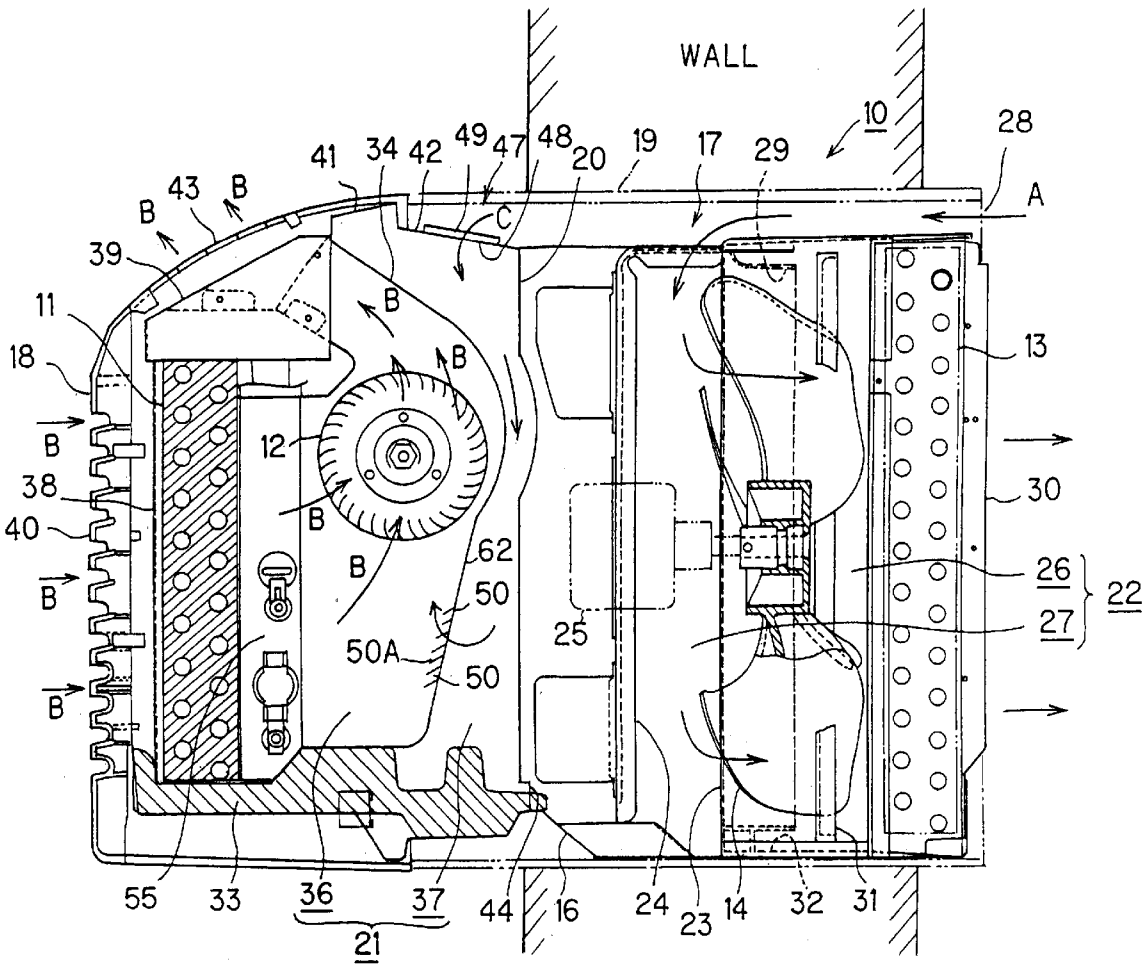
FIG. 3 is a longitudinally-sectional view of the air conditioner shown in FIG. 1.
Figure 4:
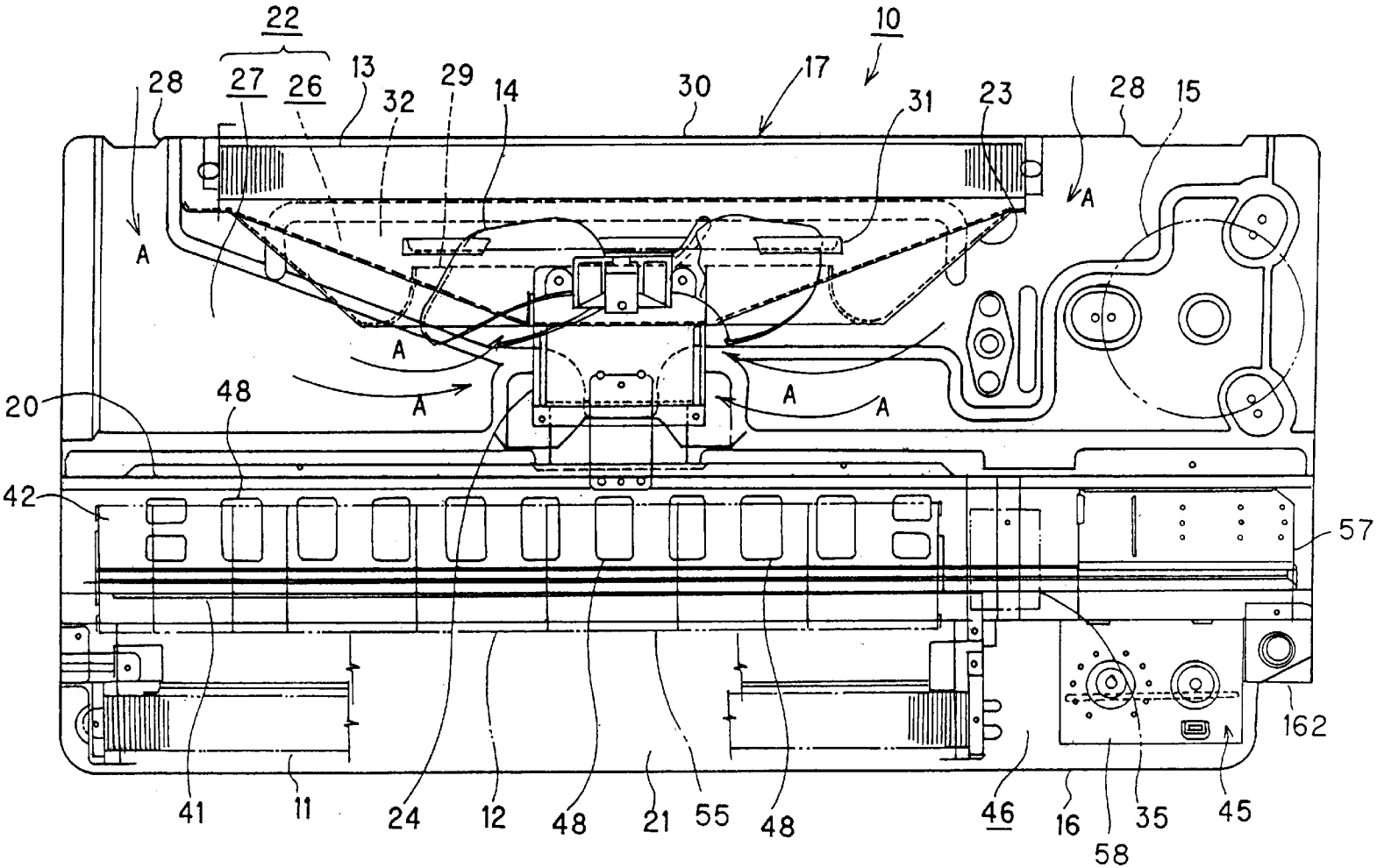
FIG. 4 is a plan view showing the air conditioner shown in FIG. 1 when the cabinet is omitted.

As shown in FIGS. 3 and 4, in the air-conditioner main body 17, a partition plate 20 is erectly equipped at the substantially center position in the front and rear direction of the bottom plate 16 so as to extend in the full-width direction of the bottom plate 16. The partition plate 20 compartments the inside of the air-conditioner main body 17 into an indoor-side chamber 21 in which the indoor heat exchanger 11, the cross-flow fan 12, etc. are arranged and an outdoor-side chamber 22 in which the outdoor heat exchanger 13, the propeller fan 14, the compressor 15, etc. are arranged. Accordingly, the front panel 18 disposed at the front side of the air conditioner 10 covers the indoor-side chamber 21, and the cabinet 19 disposed at the rear side of the air conditioner 10 compartment the surrounding of the outdoor-side chamber 22.

The outdoor heat exchanger 13, an outdoor fan casing 23, a support leg 24 and the compressor 15 are disposed at the outdoor-side chamber side on the bottom plate 16.

The compressor 15 is connected to the outdoor heat exchanger 13, a pressure reducing device (not shown) and the indoor heat exchanger in this order through a refrigerant pipe (not shown), thereby constructing a refrigeration cycle. When the air conditioner 10 is under cooling operation, the outdoor heat exchanger 13 functions as a condenser, and the indoor heat exchanger 11 functions as an evaporator. When the air conditioner 10 is under heating operation, the outdoor heat exchanger 13 functions as an evaporator, and the indoor heat exchanger 11 functions as a condenser.

The outdoor fan casing 23 is disposed so as to be connected t the outdoor heat exchanger 13, and the propeller fan 14 is disposed inside the outdoor fan casing 23. The propeller fan 14 is rotated by an outdoor driving motor 25, and the outdoor driving motor 25 is supported on the support leg 24 The outdoor-side chamber 22 is partitioned into an outdoor discharge chamber at the inside of the outdoor fan casing 23 and an outdoor suction chamber 27 at the outside of the outdoor fan casing 23 by the outdoor fan casing 23.

By rotation of the propeller fan 14, the outside air is sucked from the outdoor suction ports 28 at both the sides of the outdoor heat exchanger 13 into the outdoor suction chamber 27 as shown by arrows A of FIG. 4, passed through the a fan orifice 29 of the outdoor fan casing 23 and then discharged into the outdoor discharge chamber 26. Thereafter, the outside air is passed through the outdoor heat exchanger 13 and then discharged from the outdoor discharge port 30 to the outside. Under the cooling operation of the air conditioner 10, the outdoor heat exchanger 13 discharge heat to the outside air, and under the heating operation of the air conditioner 10, the outdoor heat exchanger 13 takes heat from the outside air.

As shown in FIG. 3, each vane of the propeller fan 14 is equipped with a slinger ring on the outer peripheral portion thereof to link the vanes to one another. Under the cooling operation of the air conditioner 10, drain water occurs on the indoor heat exchanger 11 serving as the evaporator. The drain water is collected in a drain pan 33 as described later, and then it is passed through a drain opening 44 formed at the lower end portion of the partition plate 20 and stocked into a reservoir portion 32 disposed on the bottom plate 16. The slinger ring 31 drains up the drain water stocked in the reservoir portion 32 when the propeller fan 14 is rotated, and the drain water thus drained up is scattered to the outdoor heat exchanger 13 functioning as the condenser, whereby the condensation function of the outdoor heat exchanger is enhanced.

The drain pan 33 is disposed at the indoor-side chamber side on the bottom plate 16, and the indoor heat exchanger 11 is disposed on the drain pan 33. The partition plate 20 is designed in a box-shape having an opening at the indoor-side chamber side, and an indoor fan casing 34 is disposed inside the partition plate 20.

The indoor fan casing 34 is curved from the position corresponding to a first top panel 41 (described later) of the partition plate 20 and extends to the drain pan 33, and an electrical heater 55 is disposed at the lower end portion of the drain pan 33 so as to be adjacent to the indoor heat exchanger 11. A cross-flow fan 12 is disposed at the inside of the curved indoor fan casing. Accordingly, the indoor fan casing 34 is disposed between the partition plate 20 and the cross-flow fan 12.

The cross-flow fan 12 is rotated by an indoor driving motor 35 shown in FIG. 4, and the cross-flow fan 12 and the indoor driving motor 35 are supported on the partition plate 20. The indoor fan casing 34 forms an indoor circulating chamber 36 and an outside air introducing chamber 37 at the indoor-side chamber side as shown in FIG. 3. Further, as shown in FIG. 4, an electrical-equipment chamber 46 in which an electrical-equipment mount device 45 is accommodated is formed at the indoor-side chamber side.

The indoor heat exchanger 11, the cross-flow fan 12 and the electrical heater 55 are disposed in the indoor circulating chamber 36 as shown in FIG. 3. Further, an air filter 38 and a stabilizer 39 are disposed in the indoor circulating chamber 36. The air filter 38 is disposed between a suction grille 40 formed in a front panel 18 and the indoor heat exchanger 11. The stabilizer 39 is disposed at the upper side of the indoor heat exchanger 11 so as to extend to the cross-flow fan 12. By the stabilizer 39, the air in the indoor circulating chamber 36 is excellently sucked to the indoor heat exchanger 11, and then excellently discharged from the indoor heat exchanger 11. A blow-out grille 43 for guiding the discharged air into the room of the building is formed at the upper side of the suction grille 40 on the front panel 18.

The air in the room of the building is taken from the suction grille 40 into the indoor circulating chamber 36 of the indoor-side chamber 21 by the rotation of the cross-flow fan 12. The air thus taken is passed through the air filter 38, the indoor heat exchanger 11 and the electrical heater 55 in this order, and then sucked into the cross-flow fan 12. Thereafter, the air is discharged from the cross-flow fan 12, and blown out from the blow-out grille 43 into the room. Under the cooling operation of the air conditioner 10, the indoor heat exchanger 11 cools the indoor air taken in the indoor circulating chamber 36 to cool the inside of the room. Under the heating operation, the indoor air is heated to heat the inside of the room.

The outside air introducing chamber 37 is one of constituent elements constituting a ventilation device for taking the outside air from the outdoor-side chamber 22 into the indoor circulating chamber 36 of the indoor-side chamber 21, whereby fresh air can be supplied into the room of the building. The ventilation device 47 is constructed by ventilation ports 48, a ventilation shutter 49 and a ventilation aeration portion 50A in addition to the outside air introducing chamber 37.

Figure 5:
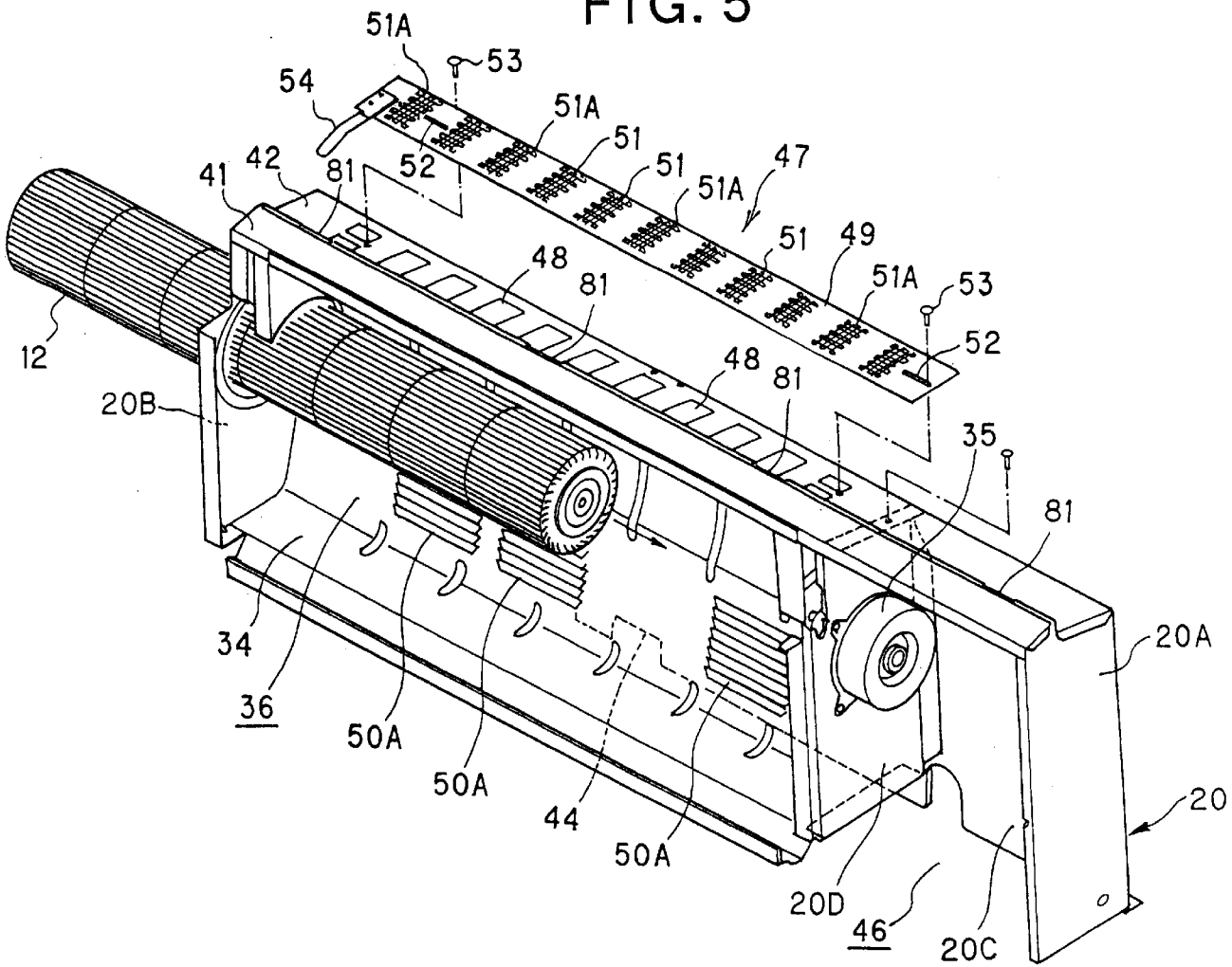
FIG. 5 is an exploded perspective view showing a partition plate, a cross-flow fan, a ventilation device, etc. of FIG. 2.

A second top panel 42 is formed at the lower position than the first top panel 41 on the box-shaped partition plate 20 so as to intercommunicate with the first top panel 41. The second top panel 42 is disposed inside the cabinet 19 compartmenting the surrounding of the outdoor-side chamber 22. As shown in FIGS. 4 and 5, a plurality of ventilation ports 48 are formed in the second top panel 42 to be juxtaposed with one another at the same pitch in the longitudinal direction of the second top panel 42.

A ventilation shutter 49 having many fine holes 51 formed therein is mounted on the second top panel 42. These fine holes 51 are gathered every group, and plural fine-hole groups 51A are arranged at the same pitch in the longitudinal direction of the ventilation shutter 49. The pitch of the fine-hole groups 51A is set to substantially the same pitch as the ventilation ports 48 of the second top panel 42.

Elongated holes 52 extending in the longitudinal direction of the ventilation shutter 49 are formed at both the end portions of the ventilation shutter 49. The ventilation shutter 49 is fixed to the second top panel 42 of the partition plate 20 through screws penetrating through the elongated holes 52 so as to be freely slidable in the longitudinal direction of the second top panel 42 and the ventilation shutter 49.

Figure 6:
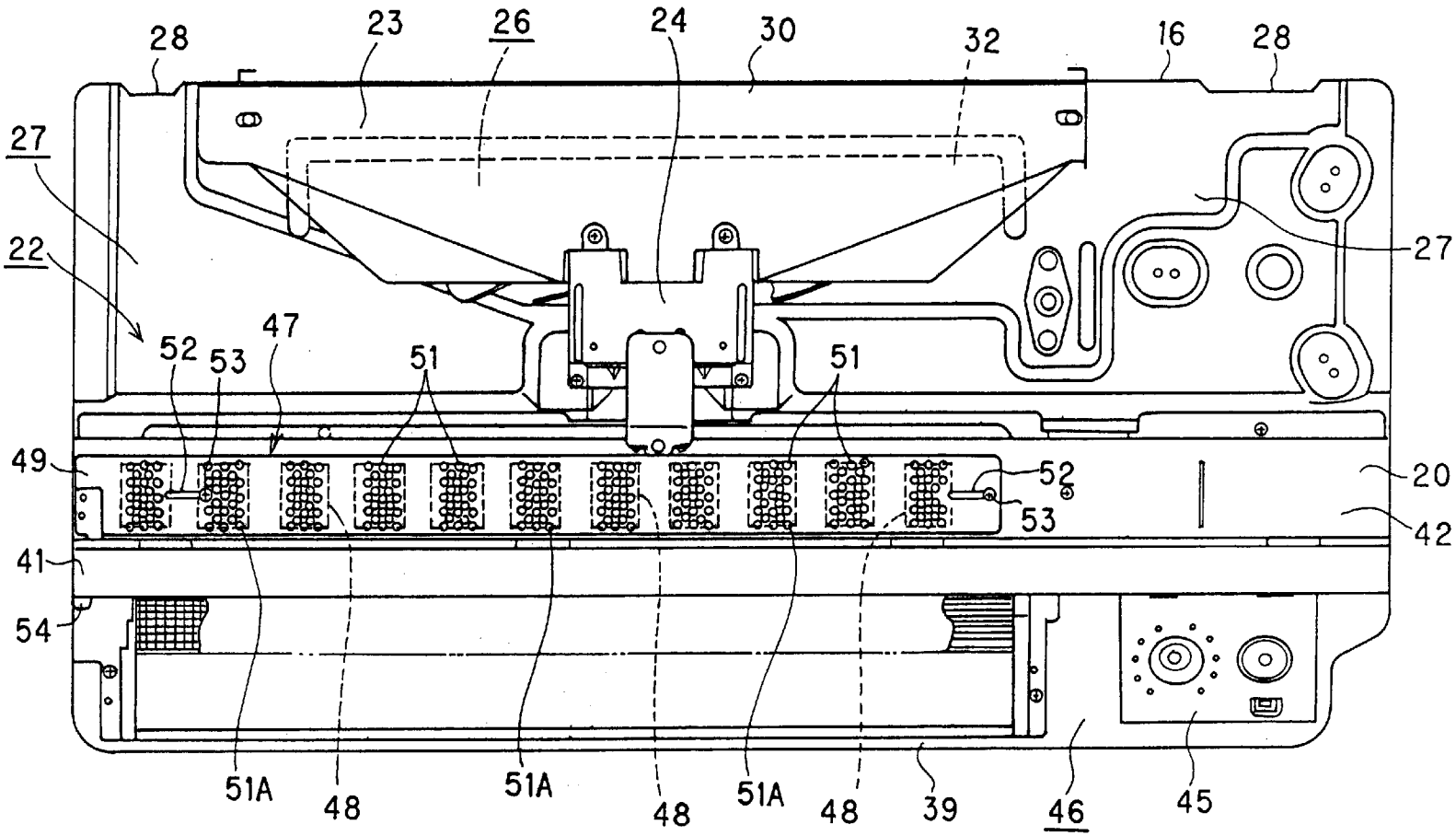
FIG. 6 is a plan view corresponding to FIG. 4, which shows a fabrication state of the ventilation device, etc. of FIG. 5.

As shown in FIG. 6, the ventilation ports 48 are fully opened at the position where the fine-hole groups 51A of the ventilation shutter 49 are positionally coincident with the ventilation ports 48 by sliding the ventilation shutter 49. On the other hand, the ventilation ports 48 are fully closed at the position where the fine-hole groups 51A are not positionally coincident with the ventilation ports 48. Further, by sliding the ventilation shutter 49 to any position between the full-open position and the full-close position, the opening degree of the ventilation ports 48 can be freely adjusted to any intermediate value between the full-open value and the full-close value, such as a half-open value, a second-thirds open value or the like. Through the opening operation of the ventilation ports 48, the outside air flowing into the outdoor-side chamber 22 is guided by the cabinet 19 to pass through the fine holes 51 of the ventilation shutter 49 and the ventilation ports 48 of the second top panel 42, and then introduced into the outside introducing chamber 37.

Here, the ventilation ports 48 are designed to be inclined downwardly to the outdoor-side chamber 22, whereby the fluid flow area of the outside air between the second top panel 42 and the cabinet 19 is more greatly enlarged as compared with the case where the ventilation ports 48 are designed to be horizontal. Further, each of the fine holes 51 of the ventilation shutter shown in FIG. 6 is formed to have a remarkably smaller diameter than the opening area of the ventilation ports 48, whereby the diameter of each fine hole 51 is set to such a value that it functions as an air filter to prevent invasion of insects, dust, etc.

The ventilation aeration portion 50A is equipped with plural vent ports 50 at the lower portion of the indoor fan casing 34 as shown in FIG. 5. The vent ports 50 are formed in a louver-shape so as to be juxtaposed with one another by cutting the lower portion of the indoor fan casing 34 into plural pieces and erecting the pieces thus achieved as shown in FIG. 5. A plurality of ventilation aeration portions 50A as described above are formed in the longitudinal direction of the indoor fan casing 34 except for the position corresponding to the drain opening 44 of the partition plate 20.

When the cross-flow fan 12 is rotated, the space below the cross-flow fan 12 in the indoor circulating chamber 36, that is, the space in the neighborhood of the ventilation aeration portions 50A is kept under negative pressure as shown in FIG. 3. Therefore, as indicated by arrows C of FIG. 3, the outside air introduced through the fine holes 51 of the ventilation shutter 49 and the ventilation ports 48 of the second top panel 42 into the outside air introducing chamber 37 downwardly flows along the outside of the curved indoor fan casing 34, passes through the aeration ports 50 of the plural ventilation aeration portions 50A and then is guided into the indoor circulating chamber 36.

The outside air thus guided into the indoor circulating chamber 36 is mixed with the indoor air air-conditioned by the indoor heat exchanger 11, and introduced from the blow-out grille 43 of the front panel 18 into the room of the building, whereby fresh air is supplied into the room.

As shown in FIG. 5, an operating lever 54 is integrally linked to one end portion of the ventilation shutter 49. The operating lever 54 is disposed so as to extend to the indoor heat exchanger 11 as shown in FIGS. 2 and 6 so that it can be manipulated when the front panel 18 is detached from the main body of the air conditioner or the like. By manipulating the operating lever horizontally, the ventilation shutter 40 is directly slid to any position with no wire, whereby the opening degree of the ventilation ports 48 can be adjusted to any value such as the full-open value, the full-close value, the half-open value, etc.

Figure 7:
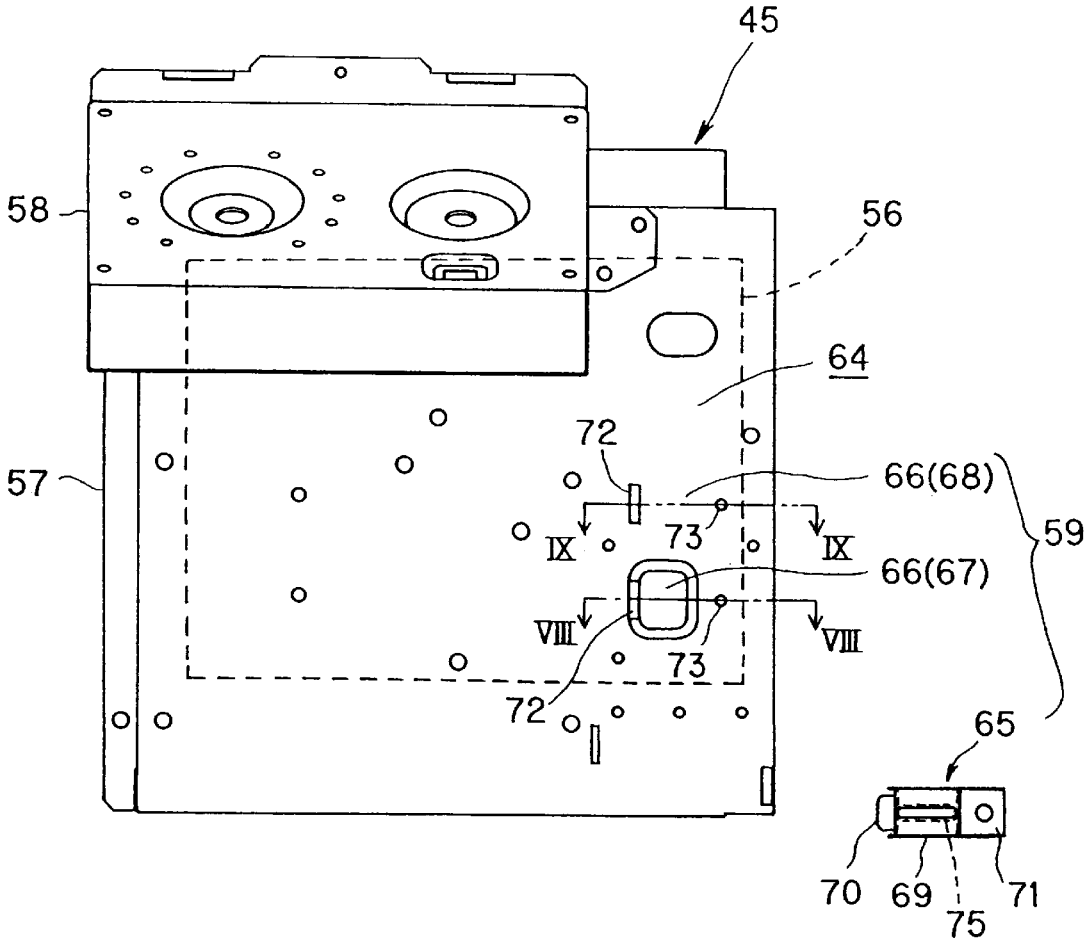
FIG. 7 is a front view showing an electrical equipment mount device having an operation box and an electrical equipment mount box.

As shown in FIGS. 2 and 7, the electrical equipment mount device 45 shown in FIGS. 2 and 4 comprises a board accommodating case 57 having the control board 56 disposed at the inside thereof, an operation box 58 having operating thumbscrews for adjusting the temperature and the air flow rate, and a wire fixing structure for fixing electrical wires 60 (see FIGS. 8A and 8B and FIGS. 9A and 9B) connected to the control board 56.

The operation box 58 is fixed to the upper portion of the board accommodating case 57. A cooling/heating temperature adjusting thumbscrew (operating switch) 61 and a cooled/heated air flow rate adjusting thumbscrew 62 (operating switch) shown in FIG. 2 are mounted on the operation box 58. A display plate 101 is interposed between the operation box 58 and each of the cooling/heating temperature adjusting thumbscrew 61 and the cooling/heating air flow rate adjusting thumbscrew 62. The display plate 69, the cooling/heating temperature adjusting thumbscrew 61 and the cooled/heated air flow rate adjusting thumbscrew 62 can be viewed when an operation door 63 of the front panel 18 is opened.

The control board 56 shown in FIG. 7 has various kinds of electronic parts such as transistors, capacitors, etc. mounted thereon, and the cross-flow fan 12, the propeller fan 14, the compressor 15, etc. are controlled on the basis of set values which are set by the cooling/heating temperature adjusting thumbscrew 61 and the cooled/heated air flow rate adjusting thumbscrew 62. A power supply circuit (not shown) is equipped on the control board 56, and electrical wires 60 (shown in FIGS. 8A to 9B) such as power supply wires, etc. are connected to the power supply circuit through a terminal board (not shown).

The wire fixing structure 59 shown in FIG. 7 serves to fix the electrical wires 60 (FIGS. 8A to 9B) to a front plate 64 serving as a wire fixing face of the board accommodating case 57 by a fixing member 65 (such as a press member or the like). The wire diameter of the electrical wire 60 to be used is varied in accordance with the magnitude of power to be supplied t the power supply circuit of the control board 56. For example, when power of 200V is supplied to the power supply circuit, the wire diameter of electrical wires 60 to be used is set to be larger than that when power of 100V is supplied to the power supply circuit.

Figure 8B:
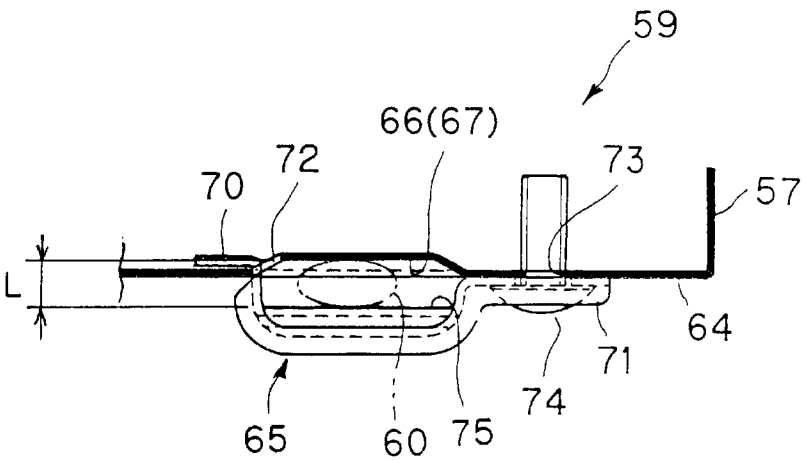
FIGS. 8A and 8B are cross-sectional views showing a wire fixing structure when the diameter of a wire is large.

As shown in FIG. 7, plural abutting portions 66 which can abut against the electrical wires 60 and are different in height are formed in the front plate 64 to which the electrical wires 60 are fixed. The abutting portion 66 comprises an abutting recess portion 67 that is formed to be recessed with respect to the front plate 64, and an abutting flat portion 68 that is formed on the same plane as the front plate 64. The abutting recess portion 67 is used to fix a thick electrical wire 60 (FIGS. 8A and 8B) having a large wire diameter, and the abutting flat portion 68 is used to fix a thin electrical wire having a small wire diameter (FIGS. 9A and 9B).

The press member 65 comprises a U-shaped press body 69 and flanges 70 and 71 which are formed integrally with the U-shaped press body 69 at both the ends of the U-shaped press body 69 as shown in FIGS. 7 to 9B, and a press portion 75 is formed on the inner surface of the press body 69 so as to expand outwardly. The flange 70 of the press member 65 is designed to be engagedly fitted in an engaging hole 72 formed one side of the abutting recess portion 67 (abutting flat portion 68) of the front plate 64. The flange 71 of the press member 65 can be fixed to front plate 64 by using fixing screw 74 which is threadedly engageable with a screw hole formed at the other end side of the abutting recess portion 67 (abutting flat portion 68) of the front plate 64.

Figure 8A:
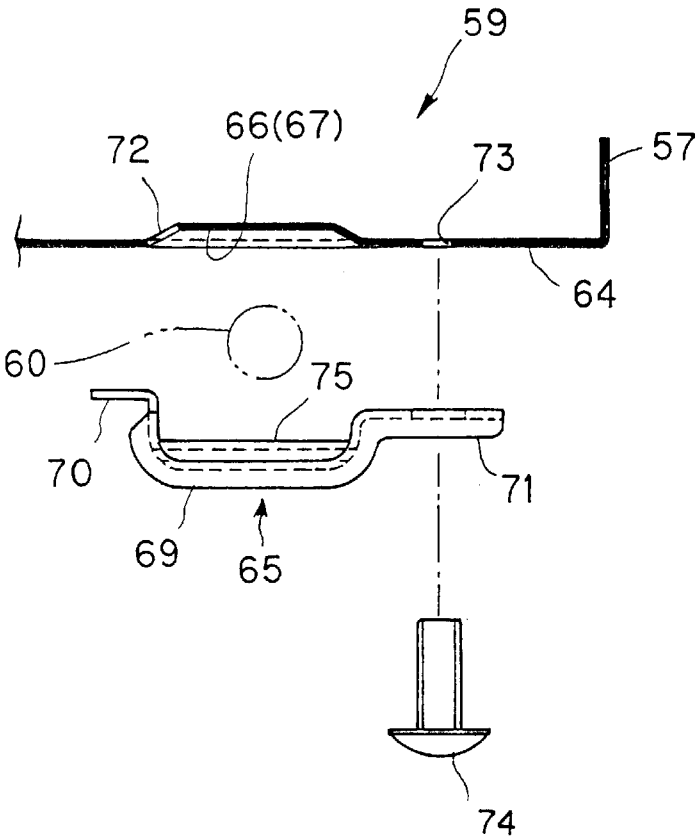
Figure 9B:
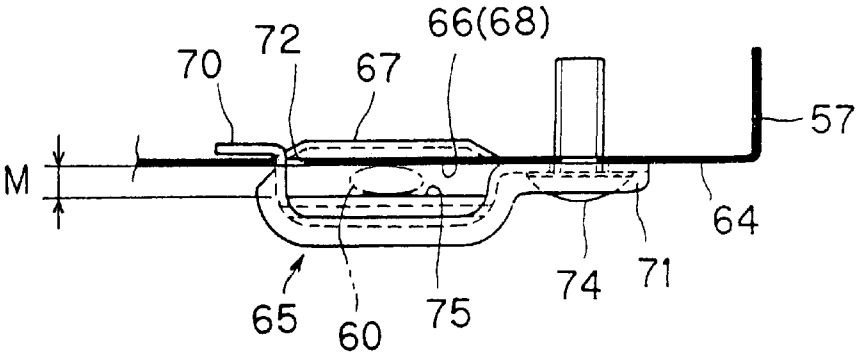
FIGS. 9A and 9B are cross-sectional views showing a wire fixing structure when the diameter of a wire is small.

As shown in FIG. 8A, when the wire diameter of the electrical wire 60 is large, the electrical wire 60 is positioned between the abutting recess portion 67 of the front plate 64 and the press member 65, the flange 70 of the press member 65 is engagedly inserted into the engaging hole 72 at one side of the abutting recess portion 67, and then the flange 71 of the press member 65 is fixed to the front plate 64 by using the fixing screw 74 which is threadedly engaged with the screw hole 73 at the other side of the abutting recess portion 67. The electrical wire 60 having a large wire diameter is fixedly mounted on the front plate 64 with being pinched between the abutting recess portion 67 and the press portion 75 of the press member 65 as shown in FIG. 8B by the press member 65 fixed to the front plate 64 as described above.

Figure 9A:
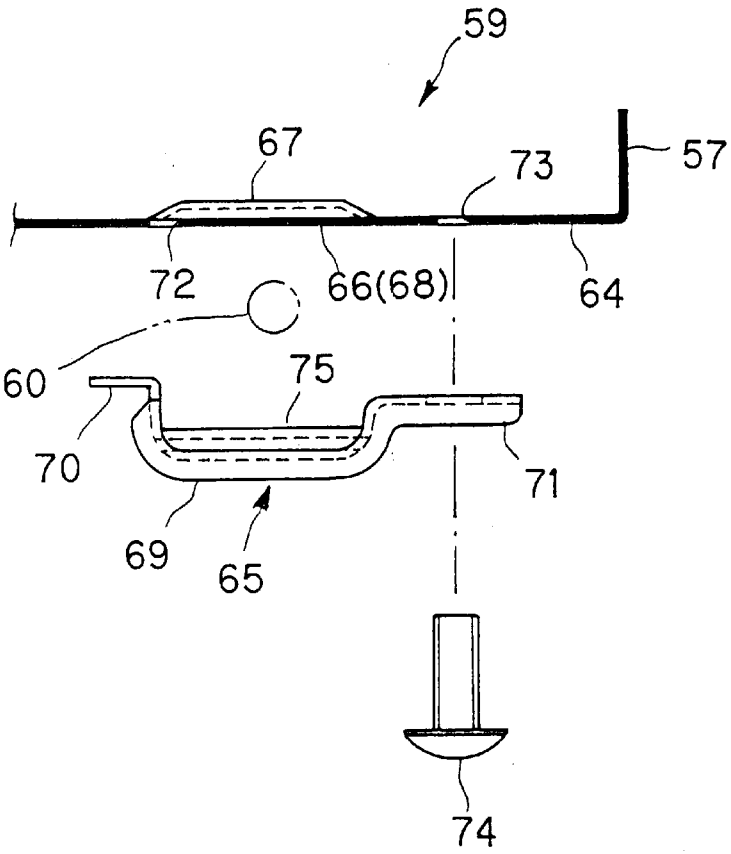

Further, as shown in FIG. 9A, when the wire diameter of the electrical wire 60 is small, the electrical wire 60 is positioned between the abutting flat portion 68 of the front plate 64 and the press member 65, the flange 70 of the press member 65 is engagedly inserted in the engaging hole 72 at one side of the abutting flat portion 68, and then the flange 71 of the press member 65 is fixed to the front plate 64 by using the fixing screw 74 which is threadedly engaged with the screw hole 73 at the other side of the abutting flat portion 68. As described above, the electrical wire 60 having a small wire diameter is fixedly mounted on the front plate 64 with being pinched between the abutting flat portion 68 and the press portion 75 of the press member 65 as shown in FIG. 9B by the press member 65 fixed to the front plate 64 as described above.

The distance L between the press portion 75 of the press member 65 and the abutting recess portion 67 and the distance M between the press portion 75 of the press member 65 and the abutting flat portion 68 when the press member 65 is fixed to the front plate 64 are set to such values that pinching force enough to prevent the electrical wire 60 from falling off the front plate 64 can be applied to the electrical wire 60 when the electrical wire is pinched between the press portion 75 of the press member and the abutting recess portion 67 (the abutting flat portion 68).

Accordingly, according to this embodiment, the following effects can be achieved.

The plural abutting portions 66 that can abut against the electrical wires 60 and are different in height (that is, the abutting recess portion 67 and the abutting flat portion 68) are formed on the front plate 64 of the board accommodating case 57 of the electrical equipment amount device, and the electrical wire 60 is pinched by the press member 65 and one of the abutting recess portion 67 and the abutting flat portion 68 to fix the electrical wire 60 concerned to the front plate 64. Therefore, one of the abutting recess portion 67 and the abutting flat portion 68 of the front plate 64 is selected in accordance with the wire diameter of the electrical wire 60, and the electrical wire 60 can be fixed by the press member 65 and the selected one of the abutting recess portion 67 and the abutting flat portion 68, so that the press member 65 can be commonly used among plural kinds of electrical wires 60. Accordingly, it is unnecessary to prepare for plural kinds of press members 65 in accordance with the wire diameter of electrical wires 60, so that the number of parts of the electrical wires 60 can be reduced and the manufacturing cost can be reduced.

The present invention is not limited to the above embodiment, and various modifications may be made without departing from the subject matter of the present invention.

For example, in the above embodiment, the depth of the abutting recess portion is set to a specific one in accordance with the wire diameter of an electrical wire to be fixed. However, the depth of the abutting recess portion is not limited to a specific one, and it may be designed to be freely variable in accordance with the wire diameter of an electrical wire to be fixed.

Further, in the above embodiment, the abutting recess portion 67 and the abutting flat portion 68 are formed on the front plate 64 of the board accommodating case 57 of the electrical equipment mount device 45. However, when an electrical wire 60 having a smaller wire diameter is fixed, an abutting projecting portion which expands outwardly from the front plate 64 may be formed on the front panel in place of or together with the abutting flat portion 68 so that the electrical wire 60 is fixedly pinched between the abutting projecting portion and the press member 65. In this case, the height of the abutting projecting portion may be designed to be freely variable in accordance with the wire diameter of an electrical wire to be fixed.

Still further, the number of abutting recess portions (abutting projecting portions) and abutting flat portions are not limited to a specific numeral, and it may be freely set to any numeral.

Still further, in the above embodiment, the present invention is applied to the electrical equipment mount device applied to the air conditioner, however, the present invention may be applied to electrical equipment mount devices for various kinds of equipment such as a showcase in which articles of food, etc. are put on show while refrigerated, an automatic vending machine, etc.

Still further, in the above embodiment, the wires to be fixed are electrical wires however, the wires may be communication wires such as telephone wires, etc.

Figure 10:
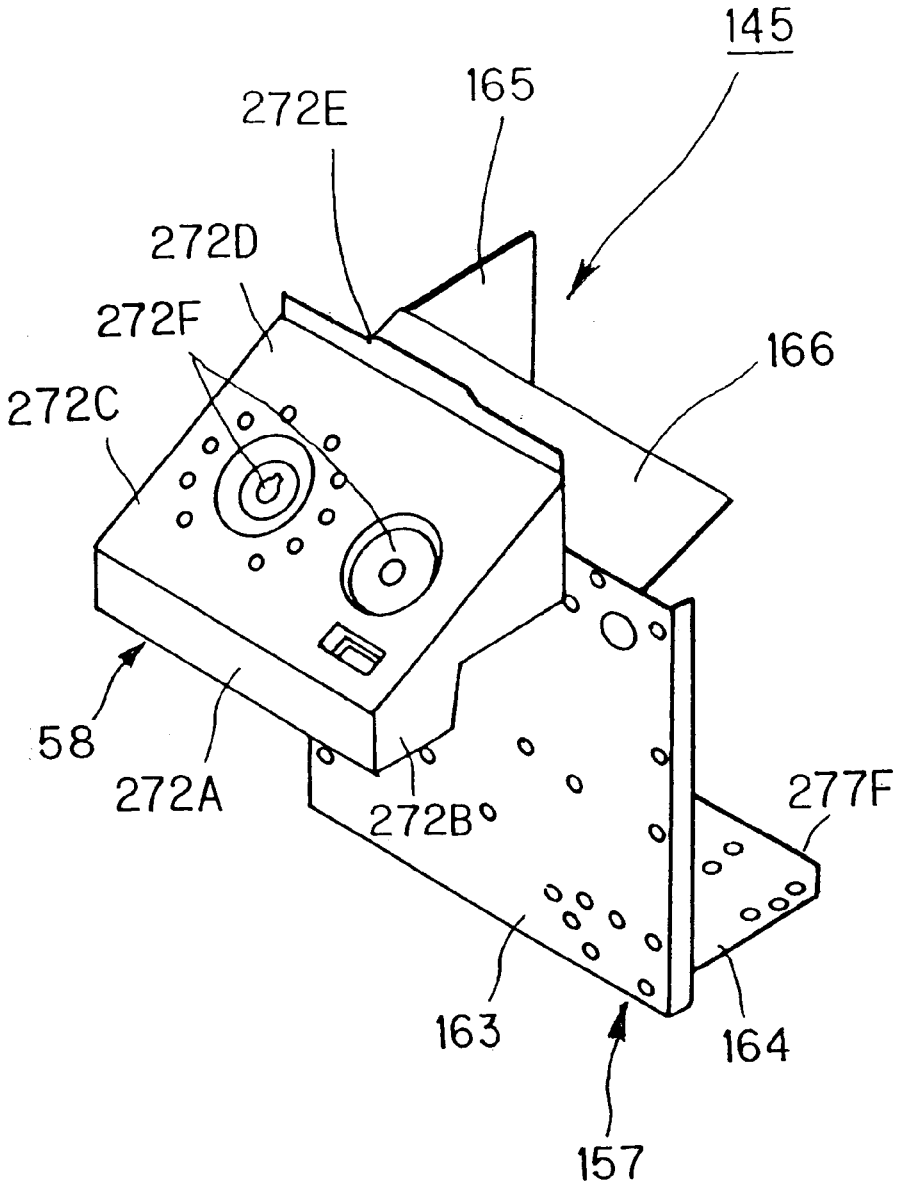
FIG. 10 is a perspective view showing an electrical equipment mount device including an operation box and an electrical equipment mount box.

FIG. 10 shows another embodiment of the electrical equipment mount device according to the present invention.

An electrical equipment mount device 145 according to this embodiment is different from the electrical equipment mount device 45 shown in FIG. 7 in that the electrical equipment mount device of this embodiment is further equipped with a conduit fixing plate 159 serving as a conduit fixing member for fixing a conduit 160 and a cover 162 for covering a terminal table 73 and the board accommodating case 57 is replaced by an electrical equipment mount box (or plate) 157 in which the control board 56 having electrical parts are disposed. It is needless to say that the board accommodating case 57 shown in FIG. 7 may be used in this embodiment.

As shown in FIG. 10, the operation box 58 has a box shape which are opened at the back and bottom surfaces thereof. It comprises a rectangular plate 272A at the front side thereof, side plates 272B and 272*c* at the right and left sides thereof and a top plate 272D at the top side thereof, which are integrally formed with one another. The top plate 272D has two holes 272F formed at the center portion thereof The side plates 272B and 272C are designed in a trapezoidal form so that the slope side of the trapezoid is inclined forwardly and downwardly. Further, a rectangular notched portion is formed at the lower portion of the back side of each of the plates 272B, 272C. Further, a collar portion 272E is integrally formed with the top plate 272D at the back side thereof so as to extend upwardly by bending a rear part of the top plate 272D vertically.

Further, the electrical equipment mount box 157 comprises a front plate portion 163, a bottom plate portion 164, a side plate portion 165 and a top plate portion 166 which are integrally formed with one another. The right-hand edge of the front plate portion 163 is backwardly bent to enhance the mechanical strength thereof, and the back-side edge of the bottom plate portion 164 is also bent upwardly to enhance the mechanical strength thereof The control board 56 is disposed on the inner surface of the front plate portion 163. Here, the back-side edge of the bottom plate means an edge of the bottom plate that is located at the outdoor-side chamber side. likewise, the front-side edge means an edge that is located at the indoor-side chamber side. Accordingly, the back-side edge in FIG. 3 is located at the right side of FIG. 3, and the front-side edge in FIG. 3 is located at the left side of FIG. 3.

The operation box 58 is fixed to the upper portion of the front plate portion 163 at the back sides of the side plates 272B and 272C thereof by using a fixing member as described later. The side plate portion 165 has a slope portion at the upper portion of the front side thereof, and the slope portion is forwardly inclined from the back side to the front side thereof The top plate portion 166 is designed in a rectangular shape so that the front and back sides thereof are slightly shorter in length than the upper side of the front plate portion 163 and the right and left sides thereof are equal to the slope portion (side) of the side plate portion 165 in length. Accordingly, the top surface of the electrical equipment mount box 157 is designed to have a forwardly-and-downwardly-inclined slope surface at the front side thereof and an opening portion at the back side thereof.

The above operation box 58 and the electrical equipment mount box 157 are inserted into the electrical equipment chamber 46 from the front side of the indoor-side chamber 21, and fixed to the partition plate 20.

Figure 11:
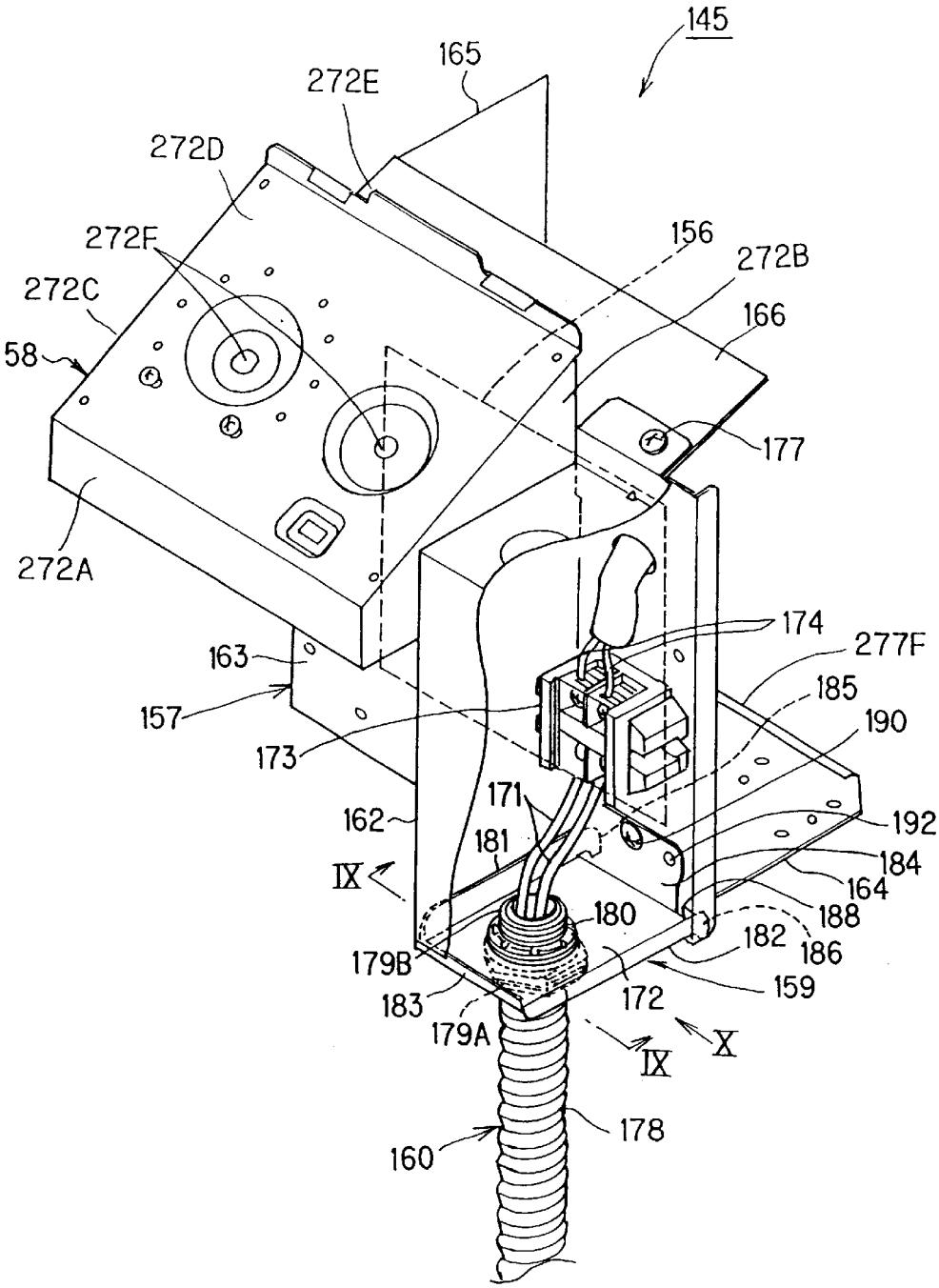
FIG. 11 is a perspective view showing the electrical equipment mount device including a conduit fixing member when a conduit is used.
Figure 12:
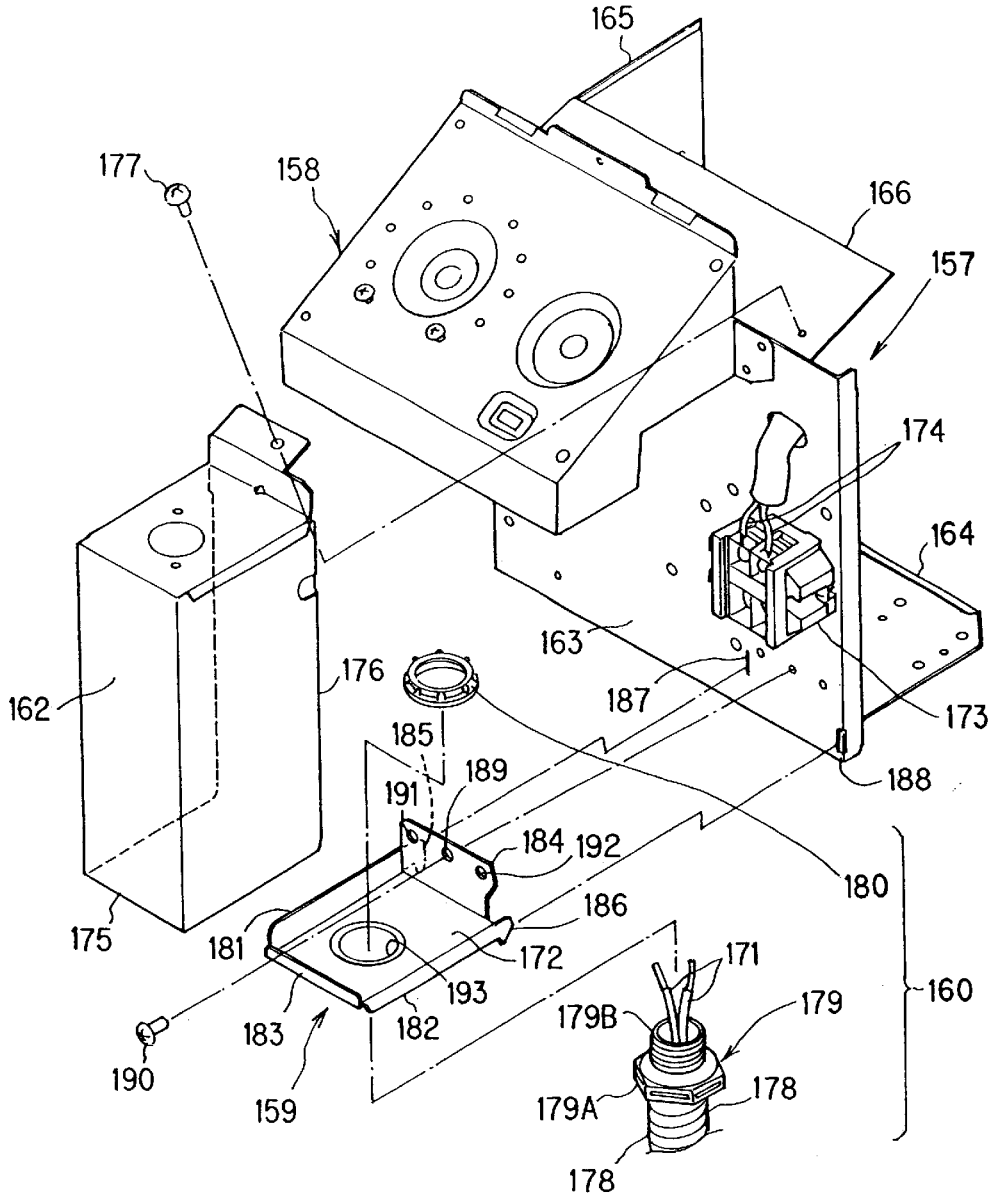
FIG. 12 is an exploded perspective view showing the electrical equipment mount device including the conduit fixing member.

FIG. 11 is a perspective view showing the electrical equipment mount device 145 to which a conduit fixing member is attached, and FIG. 12 is an exploded perspective view of the electrical equipment mount device 145 shown in FIG. 11.

As shown in FIGS. 11 and 12, electrical wires 71 for supplying power to the cross-flow fan 12, the propeller fan 14, the compressor 15, etc. are inserted in a conduit 160 shown in FIGS. 10 and 11 to be protected from the external force. The conduit 160 is used particularly when high voltage (for example, 265V or more) is applied to the electrical wires 71. The conduit 160 is fixed by inserting a hollow fixing bolt 179 into one end portion of a conduit tube 178, and the electrical wires 171 are inserted in the conduit tube 178 and the fixing bolt 179. A fixing nut 180 is threadedly engageable with a screw portion 179B of the fixing bolt 179.

A conduit fixing plate 159 is fixed to the outer surface of the front plate portion 163 of the electrical equipment mount box 157 as described later, and it has a fixing face 172 to which one end portion of the conduit 160 is fixed. The electrical wires 171 in the conduit 160 fixed to the fixing face 172 of the conduit fixing plate 159 is connected to the terminals of the terminal table 173 mounted on the outer surface of the front plate portion 163 of the electrical equipment mount box 157, whereby the electrical wires 171 are electrically connected to wires 174 which extend from the control board 156 and are connected to the other terminals of the terminal table 173.

The cover 162 is designed in a box-like shape which is opened at the lower surface portion and the back surface portion thereof. The cover 162 is disposed so that the opening edge (peripheral edge) 175 of the lower surface portion thereof is brought into contact with the conduit fixing plate 159 and the opening portion of the lower surface portion is closed by the conduit fixing plate 159. Further, the cover 162 is also disposed so that the opening edge (peripheral edge) 176 of the back surface portion thereof is brought into contact with the front plate portion 163 of the electrical equipment mount box 157 and the opening portion of the back surface portion is closed by the front plate portion 163. In addition, the cover 162 is fixed to the top plate portion 166 of the electrical equipment mount box 157 by a screw 177. Accordingly, the terminal table 173, the electrical wires 171 and the wires 174 are accommodated in the cover 162 and protected from the external force. Under the cover-fixed state, the opening edge 175 of the lower surface portion of the cover 162 is fixed between a front flange portion 183 and a first side flange portion 181 to thereby prevent falling-off from the lower portion of the cover 162.

The conduit fixing plate 159 comprises the front flange portion 183 at the front side of the fixing face 172, a back flange portion 184 at the back side thereof, the first side flange portion 181 at one side thereof and a second side flange portion 182 at the other side thereof, the flange portions being bent substantially vertically to be continuos with on each other.

A conduit fixing hole 193 through which a screw portion 179B of the fixing bolt 179 of the conduit 160 is inserted is formed in the fixing face 172 of the conduit fixing plate 159 by burring, for example. Under the state that the screw portion 179B is inserted in the conduit fixing hole 193 of the fixing face 172, the head portion 179A of the fixing bolt 179 comes into contact with the lower surface of the fixing face 172.

Figure 13:
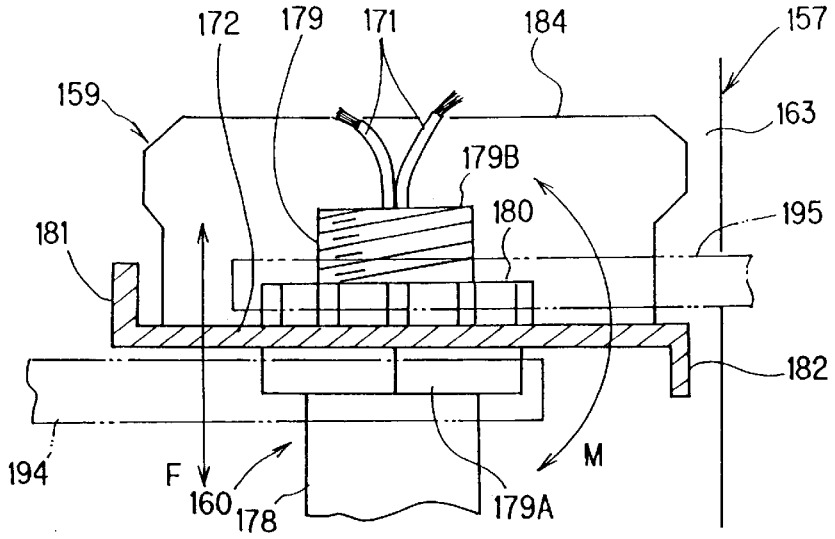
FIG. 13 is a cross-sectional view taken along IX—IX line of FIG. 11.
Figure 14:
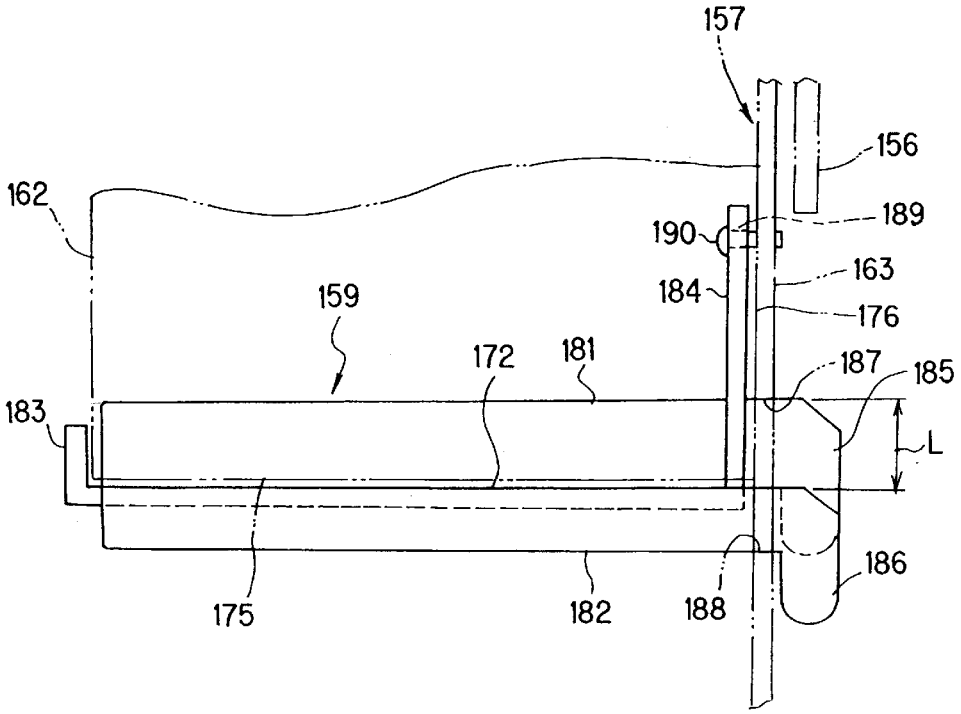
FIG. 14 is a front view showing a conduit fixing plate when viewed in the direction indicated by an arrow X.

The first side flange portion 181 and the second side flange portion 182 which are disposed so as to face each other are bent in the opposite directions. For example, as shown in FIG. 13, the first side flange portion 181 is bent in the upward direction and the second side flange portion 182 is downwardly bent. As shown in FIG. 14, engaging hooks 185 and 186 as fixing members are integrally formed with the first side flange portion 181 and the second side flange portion 182 respectively at the back flange portion (184) side. Accordingly, the engaging hook 185 and the engaging hook 186 are located at the opposite sides with respect to the fixing face 172, that is, the engaging hooks 185 and 186 are located at the upper and lower sides with respect to the fixing face 172, respectively. Reference numeral L in FIG. 14 represents the difference in height in the vertical direction between the engaging hooks 185 and 186. The engaging hooks 185 and 186 are hooked to hook holes 187 and 188 serving as fixing holes formed in the front plate portion 163 of the electrical equipment mount box 157, respectively. Accordingly, the hook holes 187 and 188 are located at different positions in the vertical direction, and the difference in height in the vertical direction therebetween is substantially equal to that between the engaging hooks 185 and 186.

As described above, the engaging hooks 185 and 186 of the conduit fixing plate 159 and the hook holes 187 and 188 of the electrical equipment mount box 157 are designed to have the difference L in height in the vertical direction. Therefore, as shown in FIG. 13, the conduit fixing plate 159 can keep rigidity to the force F acting in the vertical direction to the fixing face 172 or the moment M (torque) acting around the straight line extending in the direction from the front flange portion 183 to the back flange portion 184.

Further, as shown in FIGS. 11 and 12, a screw hole 189 is formed in the back flange portion 184 of the conduit fixing plate 159. After the engaging hooks 185 and 186 of the conduit fixing plate 159 are engagedly fitted in the hook holes 187 and 188 of the front plate portion 163 of the electrical equipment mount box 157, a fixing screw 190 is inserted into the screw hole 189 of the back flange portion 184 of the conduit fixing plate 159 and threadedly engaged with the front plate portion 163 of the electrical equipment mount box 157, whereby the conduit fixing plate 159 is fixed to the front plate portion 163 of the electrical equipment mount box 157. Reference numerals 191 and 192 of FIGS. 7 and 8 represent auxiliary screw holes.

Next, the fixing work of the conduit 60 will be described.

First, the engaging hooks 185 and 186 of the conduit fixing plate 159 are fixedly fitted in the hook holes 187 and 188 of the front plate portion 163 of the electrical equipment mount box 157 and the fixing screw 190 is inserted in the screw hole 189 of the back flange portion 184 of the conduit fixing plate 159 to fix the back flange portion 184 to the front plate portion 163, thereby fixing the conduit fixing plate 159 to the electrical equipment mount box 157.

Subsequently, the screw portion 179B of the fixing bolt 179 of the conduit 160 is inserted in the conduit fixing hole 193 formed in the fixing face 172 of the conduit fixing plate 159, and the fixing nut 180 is threadedly engaged with the screw portion of the fixing bolt 179 projecting upwardly from the fixing face 172.

At this time, as shown in FIG. 12, a fastening instrument 194 such as a spanner, a monkey wrench or the like is inserted from the let side of the conduit fixing plate 159 at which the first side flange portion 181 is equipped, and the fastening instrument 194 is fitted to the head portion 179A of the fixing bolt 179 of the conduit 160. Further, another fastening instrument 195 is inserted from the right side at which the second side flange portion 182, and the fastening instrument 195 is fitted to the fixing nut 180 of the conduit 160. Thereafter, the fixing face 172 of the conduit fixing plate 159 is clamped between the head portion 179A of the fixing bolt 179 of the conduit 160 and the fixing nut 180 by using the fastening instruments 194 and 195, thereby fixing the conduit 160 to the fixing face 172.

As described above, under the state that the conduit 160 is fixed to the conduit fixing plate 159, the electrical wires 71 in the conduit 160 are bundled and connected to the terminals of the terminal table 173, and the wires 174 of the control board 156 and the electrical wires 171 in the conduit 160 are electrically connected to one another through the terminal table 173.

Thereafter, the cover 162 is positioned so that the opening edge 175 of the lower surface portion and the opening edge 176 of the back surface portion thereof are brought into contact with the fixing face 172 of the conduit fixing plate 159 and the front plate portion 163 of the electrical equipment mount box 157, whereby the terminal table 173, the electrical wires 171 and the wires 174 are accommodated in the cover 162. Thereafter, the cover 162 is fixed to the electrical equipment mount box 157 by using the screw 177.

According to the above-described embodiment using the electrical equipment mount device thus constructed, the following effects (1) to (3) can be achieved.

(1) The engaging hooks 185 and 186 which are engagedly fitted in the hook holes 187 and 188 of the front plate portion 163 of the electrical equipment mount box 157 are equipped at different positions (upper and lower positions) with respect to the fixing face 172 to which one end portion of the conduit 160 is fixed. Therefore, the conduit fixing plate 159 has high rigidity to the force acting from the conduit 160, and the mechanical strength thereof is enhanced, so that the conduit fixing plate 159 can be designed in a compact size.

(2) The engaging hooks 185 and 186 of the conduit fixing plate 159 are engagedly fitted in the hook holes 187 and 188 of the front plate portion 163 of the electrical equipment mount box 157, whereby the conduit fixing plate 159 can be fixed to the electrical equipment mount box 157. Therefore, the fixing workability of the conduit fixing plate 159 can be enhanced, and the number of fixing screws 190 for fixing the conduit fixing plate 159 to the electrical equipment mount box 157 can be reduced, so that the manufacturing cost can be reduced.

(3) The conduit fixing plate 159 is equipped with the first side flange portion 181 and the second side flange portion 182 which are bent in the opposite directions and formed at the opposite positions with respect to the fixing face 172. Therefore, even when the fastening members 194 and 195 such as spanners or the like are inserted to the upper and lower sides of the fixing face 172 to fasten the fixing nut 180 in order to fix one end portion of the conduit 160 to the fixing face 172 with the fixing nut 180, the fastening instruments 194 and 195 can prevented from interfering with the first side flange portion 181 and the second side flange portion 182 of the conduit fixing plate 159. Therefore, the fastening work of fixing one end portion of the conduit 160 can be easily performed.

The present invention is not limited to the above embodiment, and various modifications may be made without departing from the subject matter of the present invention.

For example, in the above embodiment, two engaging hooks (the engaging hooks 159 and the 186) are formed on the conduit fixing plate 159. However, the number of the engaging hooks is not limited to two, and three or more engaging hooks may be equipped to the conduit fixing plate 159. In this case, it is necessary that at least one engaging hook is formed at an upper or lower position different from the position of another engaging hook with respect to the fixing face 172.

According to the electrical equipment mount device of this embodiment, the conduit fixing member for fixing the end portion of the conduit for electrical wires can be miniaturized. Further, the fixing workability of the conduit fixing member can be enhanced and the manufacturing cost can be reduced.

Figure 15:
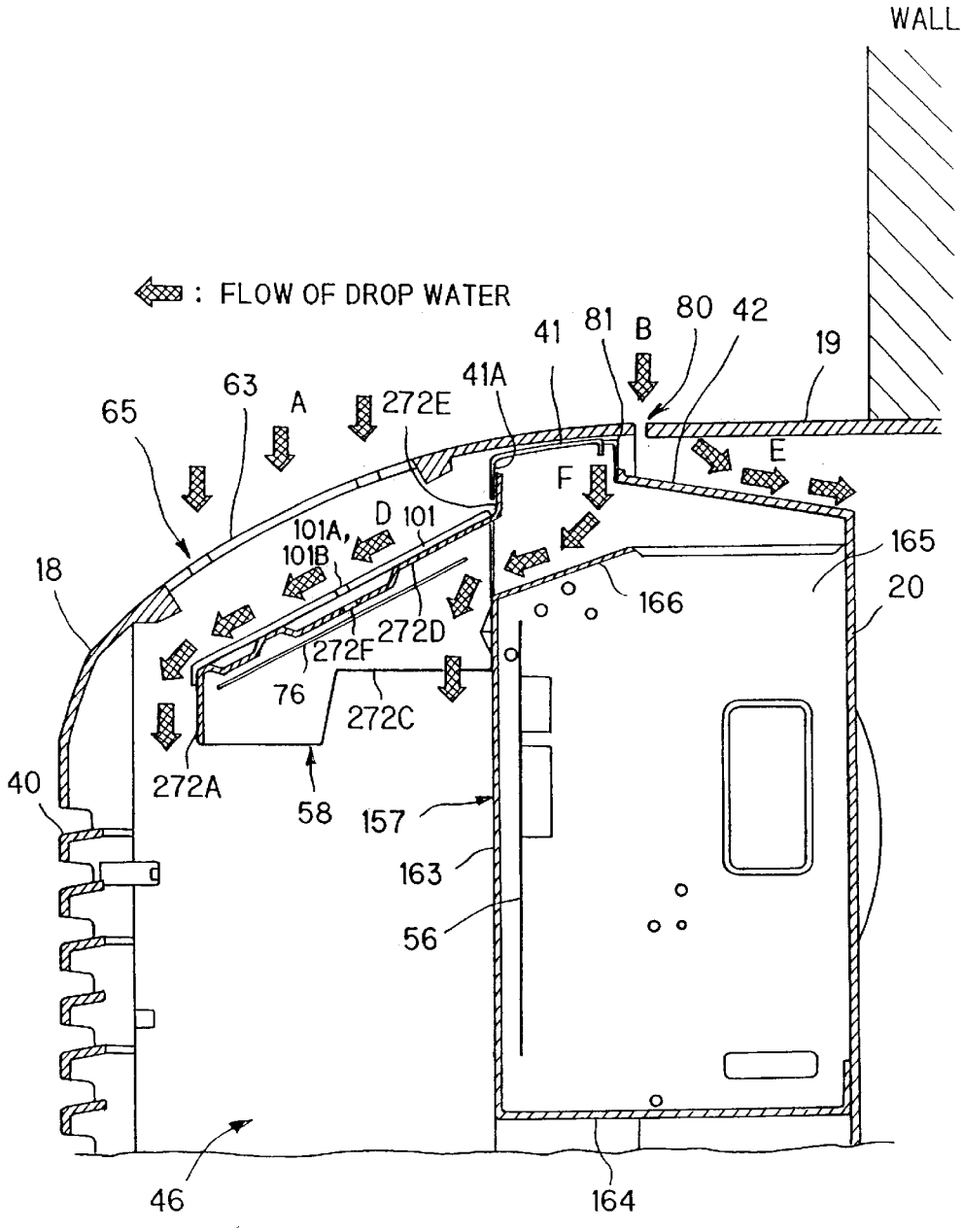
FIG. 15 is a cross-sectional view showing the arrangement of the operation box and the electrical equipment mount device in the main body of the air conditioner when they are viewed from the right side of the main body.

FIG. 15 is a cross-sectional view showing the arrangement of the operation box 58 and the electrical equipment mount box 157 in the main body of the air conditioner when they are viewed from the right side of the main body. In FIG. 15, the cover 172, the conduit fixing plate 162, etc. are omitted from the illustration. It is needless to say that this embodiment has the same effect even when these elements are provided.

The collar portion 272E of the operation box 58 is fit to the inner surface of the bent front edge portion 41A of the first top panel 41 of the partition plate 20, and then fixed to the front edge portion 41A by a fixing member such as a screw or the like to thereby fix the operation box (electrical equipment mount box) to the partition plate 20. Therefore, there occurs no gap at the joint portion between the upper portion of the operation box 58 and the first top panel 41, thereby preventing invasion of liquid such as drinking water or the like through the joint portion into the inside of the first top panel 41.

In this case, even when a circuit board 76 is mounted on the inner surface of the top plate 272D of the operation box 58 as shown in FIG. 15, invasion of driving water or the like into the circuit board 76 through the joint portion can be also prevented. the operation box 58 is disposed substantially beneath the operation door 63 of the front panel 18.

Seal (not shown) is applied to the peripheral portions of the holes 272F formed in the top plate 272D of the operation box 58. When drinking water or the like is applied to the display plate 101 or the thumbscrews 61 and 62, the seal can prevent invasion of drinking water or the like from the display plate 101 or the thumbscrews 61 and 62 through the holes 101A and 101B of the display plate 101 and the holes 272F of the operating box 58 into the operating box 58.

In this embodiment, the electrical equipment mount box 157 is fixedly mounted at the space surrounded by the right plate 20A and the back plate 20C of the partition plate 20 (FIG. 5) and thus it is embedded inside the partition plate 20. The right edge of the electrical equipment mount box 157 is superposed on the side edge of the right plate 20A at the indoor-side chamber (21) side and fixed to the side edge of the right plate 20A at plural positions by screws (not shown).

As described above, the control board 56 is mounted inside the electrical equipment mount box 157 as shown in FIG. 15. The control board 56 is fixedly mounted between the bottom plate 164 and the top plate 166 of the electrical equipment mount box 157 in parallel to the front plate portion 163 so as to be spaced from the front plate portion 163 toward the outdoor-side chamber (22) side at a distance of about 5 mm, for example.

Accordingly, even when liquid such as drinking water or the like invades into the electrical equipment mount box 157 as indicated by an arrow F in FIG. 15, the liquid flows downwardly along the slope portion of the top plate portion 166 and then along the front surface of the front plate portion 163 on which the operation box 58 is mounted. The control board 56 is mounted on the back surface of the front plate portion 163 which is located at the opposite side to the front surface, and thus the liquid can be prevented from invading into the control board 56. Therefore, electrical parts mounted on the control board 56 can be protected from liquid such as driving water or the like.

According to the arrangement of the operation box 58 and the electrical equipment mount box 157 as described above, the electrical equipment mount box 157 is disposed inside the partition plate 20 and located in an area extending outwardly (backwardly) from the outside edge (nearer to the outdoor-side chamber 22) of the opening portion 65 of the front panel 18. Further, the second top plate 42 is located substantially beneath the joint portion 80 between the front panel 18 and the cabinet 19. Therefore, the control board 56 mounted in the electrical equipment mount box 157 can be surely protected from liquid such as driving water or the like.

When a glass containing liquid such as driving water or the like is put on the front panel 18 or the cabinet 19 and carelessly turned over and thus it invades through the edge of the operation door 63 disposed on the opening portion 65 into the inside of the operation door 63 as indicated by arrows A or B in FIG. 15, the inside of the operation box 58 and the inside of the electrical equipment mount box 157 are protected from the liquid as described below.

When liquid drops in the direction indicated by the arrow A, it drops onto the slope upper surface of the operation box 58 or the display plate 101, flows along the slope upper surface and front surface of the operation box 58 or the display plate as indicated by the arrow D of FIG. 15, and finally drops onto the bottom plate 16. Therefore, the liquid dropped in the direction of the arrow A can be prevented from invading into the inside of the operation box 58 and the inside of the electrical equipment mount box 157.

When liquid drops in the direction indicated by the arrow B, it drops through the joint portion 80 between the front panel 18 and the cabinet 19 onto the second top plate 42, flows along the sloped second top plate 42 and the back surface (at the outdoor-side chamber side) of the partition plate 20 and finally drops onto the bottom plate 16 as indicated by an arrow E. Further, fixing holes 81 for fixing the first top plate 41 and the second top plate 42 exist substantially beneath the joint portion between the front panel 18 and the cabinet 19 as shown in FIGS. 5 and 14, and the top plate 166 of the electrical equipment mount box 157 is located substantially beneath the fixing holes 81. Therefore, the liquid dropping through the joint portion 80 between the front panel 18 and the cabinet 19 also flows through the fixing holes 81 into the inside of the partition plate 20 as indicated by an arrow F of FIG. 15. In this case, the liquid drops onto the top plate 166, flows downwardly along the slope portion of the top plate 166 and along the front surface of the front plate portion 163 on which the operation box 58 is mounted, and then finally drops onto the bottom plate 16. Therefore, the liquid can be prevented from invading into the inside of the electrical equipment mount box 157, and thus the control board 56 (electrical parts) can be protected from the liquid.

Here, as shown in FIG. 15, the back-side edge of the top plate (slope portion) 166 of the top plate is located so as to slightly extend to the outdoor-side chamber side as compared with the front-side edge of the second top plate 42. Therefore, the liquid drops through the fixing holes 81 surely drops on the slope portion of the top plate 166, and flows downwardly along the slope portion of the top plate 166 in the direction of the arrow F.

Accordingly, no liquid invades into the inside of the electrical equipment mount box 157, and the control board (the electrical equipment) can be protected. In addition, by shortening the length of the top plate 166, the manufacturing cost of the electrical equipment mount box 157 can be reduced.

Further, the electrical equipment mount box 157 is fixed to the inner surface of the right plate 20A of the partition plate 20, and the back surface and the right surface (plate) of the electrical equipment mount box 157 are covered by the partition plate 20. Therefore, the electrical equipment mount box 157 is fully covered substantially at all the surfaces thereof like a dosed box although it is not designed as a closed box. Accordingly, the manufacturing cost can be reduced as compared with a fully-closed box type electrical equipment mount box.

According to the above-described embodiment, there can be achieved the effect that liquid such as driving water or the like invading through the opening port is prevented from invading into the inside of the operation box and the electrical equipment mount box, so that the electrical parts can be protected from liquid.

What is claimed is:

1. An air conditioner comprising an indoor heat exchanger, an indoor fan, an outdoor heat exchanger and an outdoor fan which are integrally equipped, a cabinet disposed so as to penetrate through a wall of a building while the outdoor heat exchanger and the outdoor fan are accommodated in the cabinet, and a front panel that is located at an indoor side and fixed to the indoor-side end portion of the cabinet, the cabinet having a laterally-elongated opening portion formed at the upper portion thereof, both of an air blow-out grille and an operation control unit being disposed in juxtaposition with each other in the opening portion, and an indoor-side chamber containing the indoor heat exchanger and the indoor fan and an outdoor-side chamber containing the outdoor heat exchanger and the outdoor fan are partitioned by a partition plate fixed to the bottom plate of the cabinet at the bottom portion thereof, characterized in that said operation control unit comprises an operation box in which a first circuit board is disposed and an electrical equipment mount box in which a second circuit board is disposed, and said electrical equipment mount box is disposed in an area extending from the outdoor-side edge of said opening portion to said outdoor-side chamber.

2. The air conditioner as claimed in claim 1, wherein said electrical equipment mount box is disposed substantially beneath the joint portion between said cabinet and said front panel, and said partition plate has a first top panel extending from the upper edge of the back plate of said partition plate toward said front panel and a second top panel that is joined to said first top panel and extends toward the front side of said front panel, said first top panel being disposed to be interposed between said joint portion and said electrical equipment mount box and designed to be downwardly sloped to the outdoor-side chamber, so that liquid invading through said joint portion flows along said sloped first top plate toward the outdoor-side chamber with no invasion of the liquid into said electrical equipment mount box.

3. The air conditioner as claimed in claim 1, wherein said electrical equipment mount box is disposed substantially beneath the joint portion between said cabinet and said front panel, and said electrical equipment mount box has a front plate on which the second circuit board is disposed and a top plate extending from the upper edge of said front plate toward the outdoor-side chamber so that one edge of said top plate is located at a position nearer to the outdoor-side chamber than the joint portion between said first and second top plates of said partition plate and designed to be downwardly sloped toward the front side of said front panel, so that liquid invading through said joint portion flows along said sloped top plate toward the front side of said front plate with no invasion of the liquid into said electrical equipment mount box.

4. The air conditioner as claimed in claim 1, wherein said partition plate has a first top panel extending from the upper edge of the back plate of said partition plate toward said front panel, and a second top panel that extends toward the front side of said front panel and is bent at the front edge thereof and joined to said first top panel at the back edge thereof, said operation box has a sloped top plate on which operation switches are mounted, and said top plate is equipped with a collar portion at the back side thereof that is fixed to the bent front edge of said second top panel so that liquid invading through said opening portion flows along the surface of said sloped top plate of said operation box with no invasion of the liquid through the joint portion between said top plate of said operation box and said second top panel of said partition plate.

* * * * *

UNITED STATES PATENT AND TRADEMARK OFFICE

CERTIFICATE OF CORRECTION

PATENT NO. : 6,701,738 B2 
DATED : March 9, 2004
INVENTOR(S) : Kiyoshi Kobayashi et al.

It is certified that error appears in the above-identified patent and that said Letters Patent is hereby corrected as shown below:

Title page,
Item [73], Assignee, please add -- Sanyo Electric Air Conditioning Co., Ltd., Tochigi, Japan --

Signed and Sealed this

Second Day of August, 2005

JON W. DUDAS
*Director of the United States Patent and Trademark Office*